US005637822A

United States Patent [19]

Utsumi et al.

[11] Patent Number: 5,637,822

[45] Date of Patent: Jun. 10, 1997

[54] MIDI SIGNAL TRANSMITTER/RECEIVER OPERATING IN TRANSMITTER AND RECEIVER MODES FOR RADIO SIGNALS BETWEEN MIDI INSTRUMENT DEVICES

[75] Inventors: Naoto Utsumi; Kuninori Ohuchi; Kikuro Yamauchi; Haruhiko Matsui, all of Shizuoka-ken, Japan

[73] Assignee: Kabushiki Kaisha Kawai Gakki Seisakusho, Shizuoka-ken, Japan

[21] Appl. No.: 405,273

[22] Filed: Mar. 17, 1995

[30] Foreign Application Priority Data

| | | | |
|---|---|---|---|
| Mar. 17, 1994 | [JP] | Japan | 6-072463 |
| Mar. 17, 1994 | [JP] | Japan | 6-072464 |
| Mar. 17, 1994 | [JP] | Japan | 6-072465 |
| Mar. 17, 1994 | [JP] | Japan | 6-072466 |

[51] Int. Cl.[6] ..... G10H 1/00

[52] U.S. Cl. ..... 84/645

[58] Field of Search ..... 84/600, 645, 730, 84/734, DIG. 27

[56] References Cited

U.S. PATENT DOCUMENTS

| | | | |
|---|---|---|---|
| 4,753,146 | 6/1988 | Seiler | 84/730 |
| 4,905,560 | 3/1990 | Suzuki et al. | 84/600 |
| 4,984,499 | 1/1991 | Schille | 84/734 |
| 5,296,641 | 3/1994 | Stelzel | 84/645 X |
| 5,442,128 | 8/1995 | Bodini et al. | 84/DIG. 27 |
| 5,461,188 | 10/1995 | Drago et al. | 84/600 |

*Primary Examiner*—Stanley J. Witkowski

*Attorney, Agent, or Firm*—Evenson, McKeown, Edwards & Lenahan, P.L.L.C.

[57] ABSTRACT

A MIDI transmitter receives a MIDI signal from a MIDI instrument device connected thereto, modulates the MIDI signal into a radio signal, and transmits the radio signal. A MIDI receiver receives a radio signal prepared based on a MIDI signal, from a MIDI instrument device separate therefrom, demodulates the radio signal into the MIDI signal, and delivers the resulting MIDI signal to another MIDI instrument device connected thereto. A MIDI signal transmitter/receiver includes a transmitter block for receiving and modulating a MIDI signal from a MIDI instrument device connected thereto into a radio signal and transmitting the radio signal, a receiver block for receiving and demodulating a radio signal prepared based on a MIDI signal from the MIDI instrument device separate therefrom, and delivering the resulting signal to a MIDI instrument device connected thereto, and a reception/transmission changeover block for selectively permitting one of the transmitter block and the receiver block to operate.

10 Claims, 18 Drawing Sheets

MIDI SIGNAL TRANSMITTER/RECEIVER OPERATING IN TRANSMITTER AND RECEIVER MODES FOR RADIO SIGNALS BETWEEN MIDI INSTRUMENT DEVICES

BACKGROUND OF THE INVENTION

1. Field of the Invention

This invention relates to a MIDI (Musical Instrument Digital Interface) signal transmitter, a MIDI signal receiver, and a MIDI signal transmitter/ receiver, for transmitting and/or receiving a MIDI signal for use in transferring performance information between MIDI instrument devices including performance devices, such as keyboards and MIDI guitars, tone generators, and sequencers.

2. Prior Art

A MIDI signal is a signal conforming to MIDI standards, which provides performance information having compatibility in respect of velocity information, tone information, and control information. The MIDI signal is used e.g. by a MIDI instrument system having a keyboard (MIDI instrument device) as a performance device and a tone generator (MIDI instrument device) separate from the keyboard, for control of the tone generator. In such a conventional MIDI instrument system, the keyboard and the tone generator are connected via a MIDI cable. When a note-on operation is made on the keyboard, i.e. when a key is depressed, a MIDI signal comprised of key-on information, pitch information, and velocity information is delivered from the keyboard via the MIDI cable to the tone generator. The tone generator generates a musical tone based on the MIDI signal.

However, a MIDI instrument system of this kind suffers from the following problems: First, in installing a MIDI instrument system, it is required to connect a keyboard and a tone generator via a MIDI cable to each other. The connection of these devices by the MIDI cable is in itself troublesome. This inconvenience is markedly increased when a keyboard is connected to a plurality of tone generators. Further, if the keyboard is connected to the plurality of tone generators by chain connection via "THROU" terminals provided on each tone generator for control of tone generation, a waveform of the MIDI signal transmitted by chain connection can deteriorate due to a difference in time between a rise and a fall of an electric signal occurring when photoelectric conversion is carried out by a photocoupler used in a MIDI signal receiver circuit of each tone generator, causing an error in the tone generator. Further, when a performer plays with a MIDI guitar or a keyboard of a handy type, a MIDI cable may stand in the way, thereby preventing the performer or operator from freely moving around to give a performance as he desires. This inconvenience spoils the merit of a light weight MIDI instrument device for ease of performance realized through the utilization of the MIDI signal. Moreover, according to the MIDI standards, transfer of the MIDI signal via the MIDI cable is possible within a limit of 15 m, and hence it is impossible to give a performance with a performance device, such as a keyboard, and a tone generator positioned apart from each other by a distance larger than the limit.

SUMMARY OF THE INVENTION

It is a first object of the invention to provide a MIDI signal transmitter which makes it possible to transmit a MIDI signal between a plurality of MIDI instrument devices without using any MIDI cables therefor.

It is a second object of the invention to provide a MIDI signal receiver which makes it possible to transmit a MIDI signal between a plurality of MIDI instrument devices without using any MIDI cables therefor.

It is a third object of the Invention to provide a MIDI signal transmitter/receiver which makes it possible to transmit a MIDI signal between a plurality of MIDI instrument devices without using any MIDI cables therefor, and is capable of serving as a MIDI signal transmitter and a MIDI signal receiver in a switchable manner.

It is a fourth object of the invention to provide a MIDI signal transmitter/receiver which makes it possible to transmit a MIDI signal between a plurality of MIDI instrument devices without using any MIDI cables therefor, and is capable of automatically transmitting or delivering a MIDI signal to a MIDI instrument device separate therefrom or a MIDI instrument device connected thereto, depending on whether the MIDI signal is received from a MIDI instrument device apart therefrom or input thereto from the MIDI instrument device connected thereto.

It is a fifth object of the invention to provide a MIDI signal transmitter/receiver which makes it possible to transmit a MIDI signal between a plurality of MIDI instrument devices without using any MIDI cables therefor, and is capable of transmitting a MIDI signal between selected ones of a plurality of MIDI instrument devices, as desired.

To attain the first object, according to a first aspect of the invention, there is provided a MIDI signal transmitter for a MIDI instrument device which delivers a MIDI signal for transmission of performance information.

The MIDI signal transmitter according to the first aspect of the invention is characterized by comprising:

input means connected to the MIDI instrument device for receiving the MIDI signal delivered from the MIDI instrument device;

modulation means for modulating the MIDI signal received by the input means into a radio signal; and transmitting means for transmitting the radio signal.

In the MIDI signal transmitter according to the first aspect of the invention, the radio signal is transmitted, which is modulated with the MIDI signal delivered from the MIDI Instrument device connected thereto. Therefore, if receiver means connected to a tone generator receives the radio signal, for example, the tone generator can be controlled for tone generation based on the radio signal transmitted. This dispenses with MIDI cables conventionally required in connecting between MIDI Instrument devices.

To attain the second object of the invention, according to a second aspect of the invention, there is provided a MIDI signal receiver for a MIDI instrument device which processes performance information based on a MIDI signal for transmission of performance information.

The MIDI signal receiver according to the second aspect of the invention is characterized by comprising:

receiving means for receiving a radio signal modulated with the MIDI signal;

demodulation means for demodulating the radio signal into the MIDI signal; and output means connected to the MIDI instrument device for delivering the MIDI signal recovered by demodulation by the demodulation means to the MIDI instrument device.

The MIDI signal receiver according to the second aspect of the invention receives a radio signal modulated with a MIDI signal, and delivers the MIDI signal recovered by demodulation from the radio signal to a MIDI instrument device connected to the MIDI signal receiver. The MIDI instrument device can process performance information based on the MIDI signal thus obtained. This dispenses with MIDI cables conventionally required in connecting between MIDI instrument devices.

To attain the third object, according to a third aspect of the invention, there is provided a MIDI signal transmitter/receiver connected to a MIDI instrument device, for transmitting performance information to and receiving performance information from another MIDI instrument device apart therefrom.

The MIDI signal transmitter/receiver according to the third aspect of the invention is characterized by comprising:

a transmitter block connected to the MIDI instrument device for transmitting a radio signal based on a MIDI signal received from the MIDI instrument device;

the transmitter block comprising:

input means connected to the MIDI instrument device for receiving the MIDI signal from the MIDI instrument device;

modulation means for modulating a high-frequency signal with the MIDI signal received by the input means into the radio signal; and transmitting means for transmitting the radio signal;

a receiver block for receiving a radio signal prepared by modulating a high-frequency signal with a MIDI signal, the receiver block comprising:

receiving means for receiving the radio signal prepared by modulating the high-frequency signal with the MIDI signal;

demodulation means for demodulating the radio signal received by the receiving means into the MIDI signal; and output means connected to the MIDI instrument device for delivering the MIDI signal recovered by demodulation by the demodulation means to the MIDI instrument device;

and a transmission/reception changeover block for permitting one of the transmitter block and the receiver block to operate.

In the MIDI signal transmitter/receiver according to the third aspect of the invention, when two MIDI instrument devices each having a tone generator are connected to MIDI signal transmitter/receivers, the MIDI instrument devices are capable of controlling each other in respect of tone generation. That is, the transmitter block of one of the MIDI instrument devices can be made operative by its transmission/reception changeover block, while the receiver block of the other can be made operative by its transmission/reception changeover block. In this state, if a MIDI signal is delivered from one of the MIDI signal instruments, the transmitter block thereof modulates a high-frequency signal with the MIDI signal into a radio signal, and transmits the radio signal. The other of MIDI signal instrument receives the radio signal, and demodulates the radio signal into the MIDI signal, which is delivered to its own tone generator to generate a musical tone based thereon. Conversely, by setting the receiver block of one of the MIDI instrument devices operative, and the transmitter block of the other operative, the other can control the tone generation of the one as well. This makes it possible to transfer MIDI signals between two MIDI instrument devices without using any MIDI cables therefor. Further, since the transmitter block and the receiver block can be easily switched for use, it is not necessary to set one of them exclusively for transmitting the MIDI signal, and the other for receiving the same. Therefore, the control of tone generation by one MIDI instrument device can be switched to the control of tone generation by the other without requiring troublesome work of changing connections between the two devices.

Further, since the transmission/reception changeover block sets either the transmitter block or the receiver block operative, the MIDI transmitter/receiver may be constructed based on a simplex method to deliver or transmit the MIDI signal. This enables, for example, the local oscillator to be commonly used by the transmitter block and the receiver block.

Preferably, the MIDI signal transmitter/receiver includes memory means for storing MIDI data based on the MIDI signal delivered from the MIDI instrument device connected to the MIDI signal transmitter/receiver, and recovered MIDI data based on the MIDI signal recovered by demodulation by the demodulation means, and a signal output block for delivering a MIDI signal based on the MIDI data stored in the memory means to the transmitter block or the recovered MIDI data stored in the memory means to the MIDI instrument device connected to the MIDI signal transmitter/receiver.

According to this preferred embodiment, the memory means stores the MIDI data based on the MIDI signal delivered from the MIDI instrument device, and the recovered MIDI data based on the MIDI signal recovered by demodulation, and the signal output block delivers a MIDI signal based on the MIDI data to the transmitter block, and a MIDI signal based on the recovered MIDI data to the MIDI Instrument device to which the MIDI signal transmitter/receiver is connected. This makes it possible to adjust a difference, if any, between a transmission speed of the MIDI signal received from the MIDI instrument device, and a transmission speed of data transmitted via the transmitter block, or a difference, if any, between a transmission speed of the MIDI signal received from a MIDI signal transmitter/receiver connected to another MIDI instrument device, and a transmission speed of the MIDI signal delivered to the MIDI instrument device to which the MIDI signal transmitter/receiver is connected.

For example, the memory means is formed by a FIFO memory.

To attain the fourth object of tile invention, it is preferred that the MIDI signal transmitter/receiver includes a signal-detecting block for detecting the MIDI signal from the MIDI Instrument device connected to the MIDI signal transmitter/receiver or the MIDI signal from the receiver block, and the transmission/reception changeover block permits the transmitter block to operate when the receiver block is in an operative state, and the signal-detecting block detects the MIDI signal from the MIDI instrument device connected to the MIDI signal transmitter/receiver, and holds the receiver block in the operative state when the receiver block is in the operative state and the signal-detecting block detects the MIDI signal delivered from the receiver block.

According to this preferred embodiment, the transmission/reception changeover block permits the transmitter block to operate when the receiver block is in the operative state and the signal-detecting block detects the MIDI signal from the MIDI instrument device connected to the MIDI signal transmitter/receiver, and holds the receiver block in the operative state when the receiver block is in the operative state and the signal-detecting block detects the MIDI signal from the receiver block. That is, the MIDI signal transmitter/receiver automatically delivers a MIDI signal input thereto to the MIDI instrument device connected thereto or transmits the same to another MIDI instrument device apart therefrom, which makes it unnecessary to effect a manual switching operation to use either the transmitter block or the receiver block.

Further preferably, the MIDI signal transmitter/receiver includes memory means into which note-on data of the MIDI data based on the MIDI signal delivered from the MIDI instrument device connected to the MIDI signal transmitter/receiver can be written, writing means for writing the note-on data of the MIDI signal delivered from the MIDI instrument device connected to the MIDI signal transmitter/receiver into the memory means, and for deleting the note-on data when note-off data of the MIDI data corresponding to the note-on data is input, and note data-detecting means for detecting presence or absence of the note-on data written in the memory means, the transmission/reception changeover means inhibits the transmitter block from operating and permits the receiver block to operate when the note-on data-detecting means detects absence of the note-on data written in the memory means.

According to this preferred embodiment, the writing means writes the note-on data of the MIDI signal delivered from the MIDI instrument device connected to the MIDI signal transmitter/receiver into the memory means, and deletes the note-on data when note-off data of the MIDI data corresponding to the note-on data is input. On the other hand, the transmission/reception changeover means inhibits the transmitter block from operating and permits the receiver block to operate when the note-on data-detecting means detects absence of the note-on data in the memory means. That is, when there is no MIDI data to be transmitted by the transmitter block, the receiver block automatically performs reception of the radio signal, which enables the MIDI signal transmitter/receiver to automatically receive the MIDI signal from the MIDI instrument device connected thereto and the MIDI signal from the other MIDI instrument device apart therefrom.

Further preferably, the MIDI signal transmitter/receiver includes a counter for starting counting when the note data-detecting means detects absence of the note-on data written in the memory means, and the transmission/reception changeover block inhibits the transmitter block from operating when the note data-detecting means continues to detect the absence of the note-on data written in the memory means, until the count of the counter reaches a predetermined value.

According to this preferred embodiment, when the note data-detecting means detects a state in which no note-on data remains written in the memory means, the counter starts counting. If the note data-detecting means continues to detect the above state, until the count of the counter reaches a predetermined value, the transmitter block is inhibited from operating. Therefore, even if the MIDI instrument device immediately resumes delivery of the MIDI signal, the transmitter block can immediately resume the transmission of the MIDI signal data to thereby transmit all data of the MIDI signal from the MIDI instrument device, in a reliable manner.

To attain the fifth object of the invention, according to a fourth aspect of the invention, there is provided a MIDI signal transmitter/receiver connected to a MIDI instrument device for transmitting a MIDI signal of performance information to and receiving a MIDI signal of performance information from another MIDI instrument device.

The MIDI signal transmitter/receiver according to the fourth aspect of the invention is characterized by comprising:

a transmitter block which has a plurality of channels having different transmission frequencies from each other allotted thereto and is connected to the MIDI instrument device for transmitting a radio signal based on a MIDI signal received form the MIDI instrument device;

the transmitter block comprising:

input means connected to the MIDI instrument device for receiving the MIDI signal from the MIDI instrument device;

modulation means for modulating a high-frequency signal with the MIDI signal received by the input means into a radio signal; and transmitting means for transmitting the radio signal;

a receiver block which has a plurality of channels having respective reception frequencies different from each other allotted thereto for receiving a radio signal prepared by modulating a high-frequency signal with a MIDI signal, the receiver block comprising:

receiving means for receiving the radio signal prepared by modulating the high-frequency signal with the MIDI signal;

demodulation means for demodulating the radio signal received by the receiving means into the MIDI signal; and output means connected to the MIDI instrument device for delivering the MIDI signal recovered by demodulation by the demodulation means to the MIDI instrument device;

and a channel changeover block for selecting one of the plurality of channels for use.

In the MIDI signal transmitter/receiver according to the fourth aspect of the invention, the transmitter block modulates a high-frequency signal by the MIDI signal delivered from the MIDI instrument device connected to the MIDI signal transmitter/receiver, and transmits the resulting radio signal. Then, a MIDI signal transmitter/receiver connected to a tone generator as another MIDI instrument device receives the radio signal, based on which the tone generator is controlled for tone generation. On the other hand, the receiver block receives a radio signal transmitted from a MIDI signal transmitter/receiver connected to another MIDI instrument device, and demodulates the radio signal into the MIDI signal, which is then delivered, e.g. to the tone generator associated therewith. The tone generator is controlled for tone generation based on the MIDI signal. This makes it possible to transmit the MIDI signal between two MIDI instrument devices.

Further, if the transmitting frequency of a MIDI signal transmitter/receiver connected to one MIDI instrument device and the receiving frequency of MIDI signal transmitter/receivers connected to two other MIDI instrument devices are set to an identical frequency (f1), it is possible to simultaneously control the two MIDI instrument devices by a signal output from the one MIDI instrument device. Further, if the transmitting frequency of a MIDI signal transmitter/receiver connected to a still another MIDI instrument device is set to a different frequency (f2) from the above frequency (f1), and one of the above MIDI signal transmitter/receivers connected to the two other MIDI instruments is switched to the different frequency (f2) by operating the channel changeover block, the aforementioned one MIDI instrument device and the still other MIDI instrument device can control, for tone generation, the other MIDI instrument devices having respective receiving frequencies equal to corresponding transmitting frequencies of the transmitting two MIDI instrument devices, independently of each other. This makes it possible to design performance systems with variety by changing a combination of a plurality of MIDI instrument devices.

The above and other objects, features, and advantages of the invention will become more apparent from the following detailed description taken in conjunction with the accompanying drawings.

DETAILED DESCRIPTION

Next, the invention will be described in detail with reference to the drawings showing a preferred embodiment thereof. In this embodiment, a MIDI signal transmitter for transmitting a radio signal based on a MIDI signal input thereto, and a MIDI signal receiver for receiving a radio signal to deliver a MIDI signal recovered therefrom are integrated into one unit of a MIDI signal transmitter/receiver by way of a component part for switching between the function of tile transmitter and the function of the receiver when in use. However, the MIDI signal transmitter and the MIDI signal receiver may be provided as respective separate units.

Figure 1:
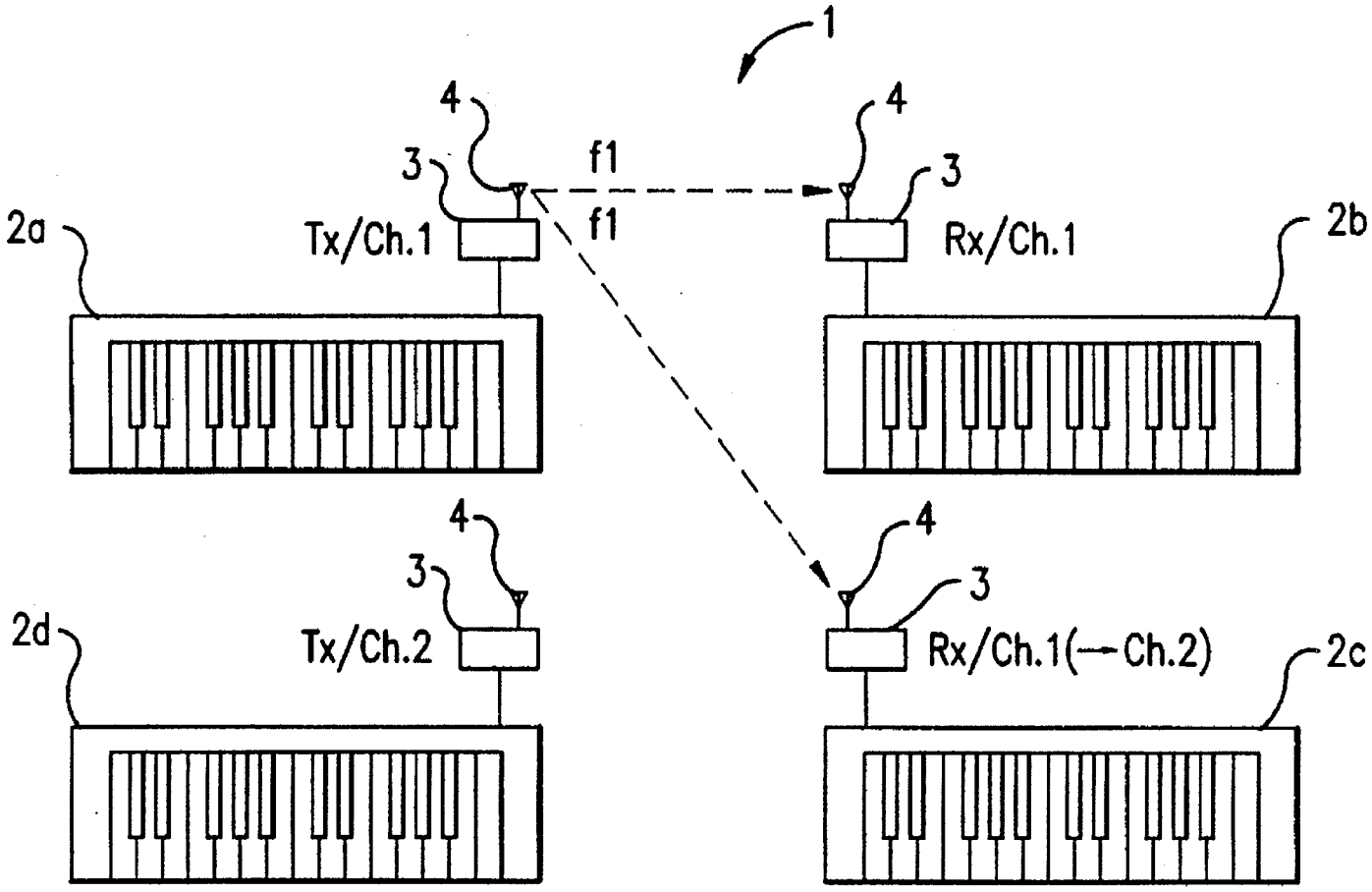
FIG. 1 is a diagram schematically showing a MIDI instrument system comprised of a plurality of keyboards each incorporating a MIDI signal transmitter/receiver according to an embodiment of the invention.

FIG. 1 schematically shows a MIDI instrument system 1 to which is applied the present invention. As shown therein, the MIDI instrument system 1 is composed of four separate keyboards (MIDI instrument devices) 2*a*, 2*b*, 2*c*, 2*d* (hereinafter, each of the keyboards will be referred to as "the keyboard 2" unless one is specifically discriminated from the others"). Each keyboard 2 has a tone generator (MIDI instrument device, not shown), and a MIDI signal transmitter/receiver (hereinafter referred to as "the transmitter/receiver") 3 incorporated therein. Each transmitter/receiver 3 has an antenna 4 mounted thereon for transmitting and receiving radio signals.

The MIDI instrument system 1 is constructed such that each keyboard 2 can transmit the radio signal to other keyboards 2 to thereby control the tone generation of the keyboards. As a result, a performance can be imparted with ensemble effects, or alternatively, the keyboards 2 can be set to different tone colors and tone qualities in advance, respectively, to thereby cause each selected one of the keyboards to give a desired performance. More specifically, as illustrated in the figure, let it be assumed that the transmitting frequency of a radio signal transmitted by the keyboard 2*a* is set to f1 (e.g. allotted to Ch. 1 (channel 1)), and the receiving frequency of the radio signal received by the keyboards 2*b*, 2*c* is set to f1 (e.g. allotted to Ch. 1). If a performer plays the keyboard 2 to generate a MIDI signal, the radio signal formed by modulation with the MIDI signal is transmitted to the keyboards 2*b*, 2*c*, which each receive and demodulate the radio signal into the MIDI signal, and generate musical tones based on the MIDI signal thus obtained. When the transmitting frequency of the keyboard 2*d* and that of the keyboard 2*c* are each set to f2 (e.g. allotted to Ch. 2), the keyboard 2*a* and the keyboard 2*d* can separately control the keyboard 2*b* and the keyboard 2*c*, respectively, for tone generation.

The aforementioned tone generator generates a musical tone corresponding to a depressed key of the keyboard 2 in which the tone generator is incorporated, or a musical tone corresponding to a MIDI signal transmitted from another keyboard 2 apart therefrom. The transmitter/receiver 3 is capable of operating in a transmitter mode or in a receiver mode, in a switchable manner. In the transmitter mode, a radio signal prepared by modulation with a MIDI signal corresponding to a performance signal, such as a note-on signal and a note-off signal, is transmitted to other keyboards 2, while in the receiver mode, a radio signal transmitted from another keyboard 2 is received, and is demodulated into a MIDI signal. The MIDI signal thus recovered is delivered to the keyboard (main part) 2, specifically to the tone generator.

Next, the arrangement of the transmitter/receiver 3 will be described with reference to FIG. 2. The transmitter/receiver 3 is comprised of a CPU 11, a control data storage block 12, a switch block 13, a MIDI data input block 14, a transfer data temporary storage block 15, a control signal output block 16, a transmission data output block 17, a transmitter/receiver block 18, a received data input block 19, a MIDI data output block 20, and an assigner 21.

The CPU 11 controls the overall operation of the transmitter/receiver 3. More specifically, it performs control concerning detection of an on/off status of each switch, not shown, of the switch block 13, input/output control (including the function of signal detection) of a MIDI signal delivered to or received from the keyboard (i.e. main part thereof other than the transmitter/receiver 3 and the antenna 4) 2, writing of MIDI data based on the MIDI signal input to the transmitter/receiver 3 into the transfer data temporary storage block 15 and reading the same therefrom, writing of the MIDI data into the assigner 21 and deleting and detection of the MIDI data therein, as well as transmission/reception changeover control, control of transmitting/receiving frequencies, transfer control of transmission and reception data, for the transmitter/receiver block 18, and so forth.

The control data storage block 12 stores operation programs of the CPU 11, control data for controlling a transmitting or receiving frequency in each channel number of the transmitter/receiver block 18 having a plurality of channels.

The switch block 13 includes a transmitter mode switch, a receiver mode switch, an automatic changeover mode switch, a performance mode switch, and a channel switch, none of which are shown.

The transmitter mode switch sets the transmitter/receiver 3 to the transmitter mode when it is turned on or depressed, while the receiver mode switch sets the transmitter/receiver 3 to the receiver mode when it is turned on, or depressed. When one of these switches is on, the transmitter/receiver 3 is in a manual mode in which the operating mode of the transmitter/receiver 3 has been manually fixed. The automatic changeover mode switch sets the transmitter/receiver 3 to the automatic changeover mode in which the transmitter/receiver 3 is automatically switched between the transmitter mode and the receiver mode. It should be noted that the transmitter mode switch and the receiver mode switch are applied in preference to the automatic changeover mode switch, and hence if the transmitter mode switch or the receiver mode switch is turned on when the transmitter/receiver 3 is in the automatic changeover mode set by turning-on the automatic changeover mode switch, the transmitter/receiver 3 is preferentially set to the manual mode, i.e. to the transmitter mode or the receiver mode. The performance mode switch is turned on when the transmitter/receiver block 18 is separated in function from the rest of the keyboard 2 to cause the keyboard 2 to operate as a single or isolate MIDI instrument unit. The setting via the performance mode switch is applied in preference to the first three mode switches described above.

The channel switch is used in selecting one of a plurality of transmitting and receiving channels (Ch.) of the transmitter/receiver block 18.

The MIDI data input block 14 is an interface circuit which converts data of a MIDI signal received from the keyboard 2 (as the main part thereof other than the transmitter/receiver 3 and tile antenna 4) in a serial form into a MIDI signal in a parallel form.

The transfer data temporary storage block 15 is formed by a so-called FIFO (First-in First-out) memory, and when the transmitter/receiver 3 is in the transmitter mode, the MIDI data received via the MIDI data input block 14 from the main part of the keyboard 2 is sequentially written into the transfer data temporary storage block 15. The MIDI data written therein is read by the CPU 11 in the written order, and transmitted via the transmitter/receiver block 18 as a radio signal to another keyboard 2 apart from the transmitter/receiver 3. On the other hand, when the transmitter/receiver 3 is in the receiver mode, the MIDI data received via the transmitter/receiver block 18 and the received data input block 19 from the other keyboard 2 is also sequentially written into the transfer data temporary storage block 15. The MIDI data written therein is sequentially read by the CPU 11 and delivered via the MIDI data output block 20 to the keyboard (main part) 2. In the transfer data temporary storage block 15, the address of the FIFO memory at which MIDI data is to be written is indicated by a writing pointer, and the address of the FIFO from which MIDI data is to be read is indicated by a reading pointer. Further, when no MIDI data is stored in the FIFO memory, the CPU 11 sets a FIFO empty flag used therein.

The control signal output block 16 delivers a transmission control signal (press signal), transmitting channel control data, and receiving channel control data to the receiver/transmitter block 18.

The transmission data output block 17 converts a MIDI signal in a parallel form based on MIDI data read from the transfer data temporary storage block 15 into a MIDI signal in a serial form.

Figure 3:
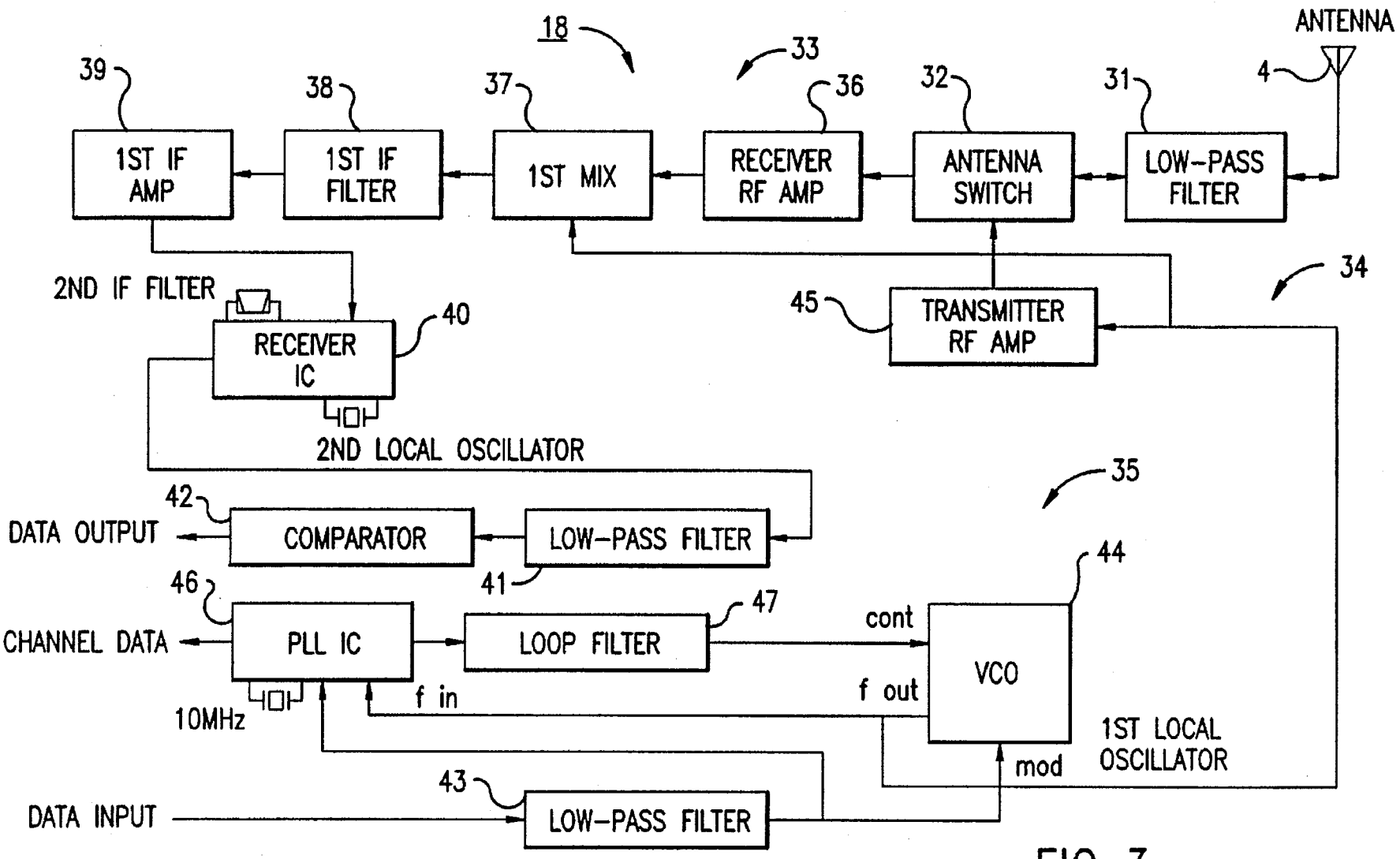
FIG. 3 is a block diagram showing a transmitter/receiver block appearing in FIG. 2 MIDI signal transmitter/receiver device.

The transmitter/receiver block 18 includes a transmitter block 34, described hereinafter with reference to FIG. 3, for transmitting a radio signal, and a receiver block 33, described hereinafter with reference to FIG. 3, for receiving a radio signal. The transmitter block 34 generates the radio signal by modulating a high-frequency signal (carrier signal) with the MIDI signal input to the transmitter/receiver 3, which is delivered for transmission via the antenna 4. The receiver block 33 receives the radio signal via the antenna 4 from the other keyboard 2, and demodulates the radio signal into the MIDI signal to deliver the same to the received data input block 19.

The received data input block 19 converts the MIDI signal in a serial form delivered from the receiver block of the transmitter/receiver block 18 into a MIDI signal in a parallel form.

The MIDI data output block 20 converts the MIDI signal in the parallel form based on the MIDI data read from the transfer data temporary storage block 15 into a MIDI signal in a serial form, and delivers the same to the keyboard (main part) 2.

The assigner 21 is a memory for storing data indicative of an on/off status of every note number in every MIDI channel, which is input to the MIDI data input block 14 and the received data input block 19. Therefore, all the keys of the MIDI channels are made correspondent to memory areas of the assigner 21 having the address and bit value, and when note-on data of a specific key number is input to the transmitter/receiver 3 via the MIDI data input block 14 or the received data input block 19, the CPU 11 writes data of "1" into a predetermined memory area of the assigner 21.

Next, the construction of the transmitter/receiver block 18 appearing in FIG. 2 will be described in detail with reference to FIG. 3.

The transmitter/receiver block 18 is an FM transmitter/receiver having a transmitting/receiving frequency band of 430 MHz, a transmitting output power of 10 mW, and 40 channels of transmitting/receiving channels. As shown in the figure, the transmitter/receiver block 18 is comprised of a low-pass filter 31, an antenna switch 32, the receiver block 33, the transmitter block 34, and a first local oscillator 35.

The low-pass filter 31 prevents interference waves from being received in the receiver mode, and prevents unwanted waves from being transmitted in the transmitter mode. The antenna switch 32 changes over between the use of the antenna in the receiver mode and that of the antenna in the transmitter mode. That is, the antenna 4 is selectively connected via the low-pass filter 31 and the antenna switch 32 to the receiver block 33 in the receiver mode, and to the transmitter block 34 in the transmitter mode.

The receiver block 33 is comprised of a receiver RF amplifier 36, a first mixer 37, a first IF filter 38, a first IF amplifier 39, a receiver IC 40, a low-pass filter 41, and a comparator 42. The receiver RF amplifier 36 amplifies the received radio signal by a predetermined gain. The first mixer 37 generates an intermediate-frequency signal (IF signal) by mixing the radio signal and a first local oscillation signal generated by a VCO (Voltage Controlled Oscillator) 44, referred to hereinafter. The first IF filter 38 is formed by a crystal filter which enhances selectivity of the receiver IF circuit. The first IF amplifier 39 amplifies the IF signal by a predetermined gain. The receiver IC 40 enhances the selectivity of the IF circuit by the use of a second IF filter incorporated therein, and after amplifying the IF signal by an amplifier incorporated therein, mixes a second local oscillation signal generated by a second local oscillator incorporated therein with the IF signal to thereby demodulate the IF signal into a low-frequency signal by quadrature detection. The low-pass filter 41 filters the low-frequency signal delivered from the receiver IC 40, and the comparator 42 shapes the low-frequency signal filtered by the low-pass filter 41 into a MIDI signal.

Figure 2:
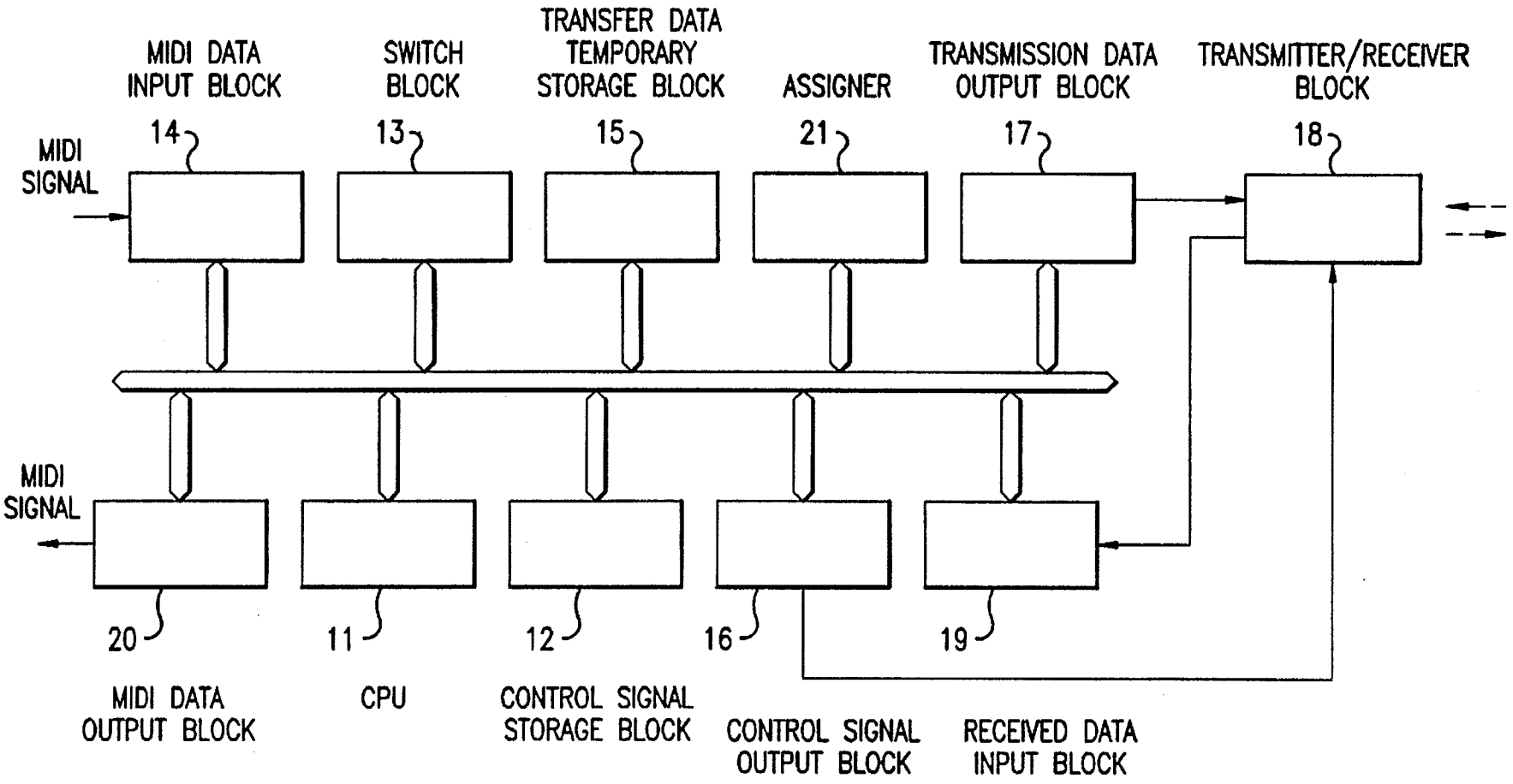
FIG. 2 is a block diagram showing the whole arrangement of one of the MIDI signal transmitter/receivers appearing in FIG. 1.

The transmitter block 34 is comprised of a low-pass filter 43 for limiting a frequency band of the MIDI signal as a transmitting data signal delivered from the transmission data output block 17 in FIG. 2, the VCO 44 which forms part of the first local oscillator 35 and serves as a modulating block, and a transmitter RF amplifier 45 which amplifies the radio signal prepared by modulation by the VCO 44.

The first local oscillator 35 is commonly used as a channel oscillator by the receiver block 33 and the transmitter block 34, and is comprised of the aforementioned VCO 44, a PLL (Phase Locked Loop) IC 46 for controlling oscillation of the VCO 44, and a loop filter 47 for smoothing oscillation control voltage delivered from the PLL IC 46. The PLL IC 46 causes the VCO 44 to oscillator at a channel frequency selected for transmission and reception, based on the transmitting channel control signal and the receiving channel control signal, delivered from the control signal output block 16.

Next, the operation of the transmitter/receiver 3 will be described separately for the automatic changeover mode and the manual mode.

In the automatic changeover mode, the transmitter/receiver 3 including the transmitter/receiver block 18 is normally set to the receiver mode, whereby it is in a standby state for receiving a MIDI signal via the MIDI data input block 14 from the keyboard (main part) 2, and a MIDI signal via the transmitter/receiver block 18 from the other keyboard 2. In the standby state, when the MIDI signal is received via the MIDI data input block 14 from the keyboard (main part) 2, the whole transmitter/receiver 3 including the transmitter/receiver block 13 is automatically set to the transmitter mode, to thereby transmit the MIDI signal received via the transmission data output block 17 and the transmitter/receiver block 18 to the other keyboard 2. On the other hand, when the MIDI signal is received via the transmitter/receiver block 18 and the received data input block 19 from the other keyboard 2, the whole transmitter/receiver 3 including the transmitter/receiver block 13 is automatically set to the receiver mode, to thereby deliver the MIDI signal received from the other keyboard 2 via the MIDI data output block 20 to the keyboard (main part) 2.

In the manual mode, it is possible to select one of the transmitter mode and the receiver mode in an alternative manner. More specifically, in the manual mode, the keyboard 2 can be fixedly used as either the performance device or the tone generator. When the transmitter mode switch is turned on in the manual mode, the transmitter/receiver 3 is set to the transmitter mode, and when a MIDI signal is received via the MIDI data input block 14 from the keyboard (main part) 2, the MIDI signal is transmitted via the transmission data output block 17 and the transmitter/receiver block 18 to the other keyboard 2. On the other hand, when the receiver mode switch is turned on, the transmitter/receiver 3 is set to the receiver mode, and when a MIDI signal is received via the transmitter/receiver block 18 and the received data input block 19 from the other keyboard 2, the MIDI signal is delivered via the MIDI data output block 20 to the keyboard (main part) 2.

Next, the operation of the transmitter/receiver 3 will be described in detail with reference to FIG. 4 to FIG. 15. It should be noted that the processings described hereinafter are all executed by the CPU 11, unless otherwise specified. Further, in these processings, flags, are used which are enumerated below. When each of the flags, the names of which are listed on the lefthand column, is set, the transmitter/receiver 3 is in a state corresponding thereto described on the righthand column.

Transmission/reception flag: transmitter mode

Automatic changeover mode flag: automatic changeover mode

FIFO empty flag: empty state of FIFO

Changeover-permitting flag: state immediately after switched to the automatic changeover mode, or standby state in the automatic changeover mode, after transmission or reception of data is once terminated, and before subsequent transmission or reception starts.

Figure 4:
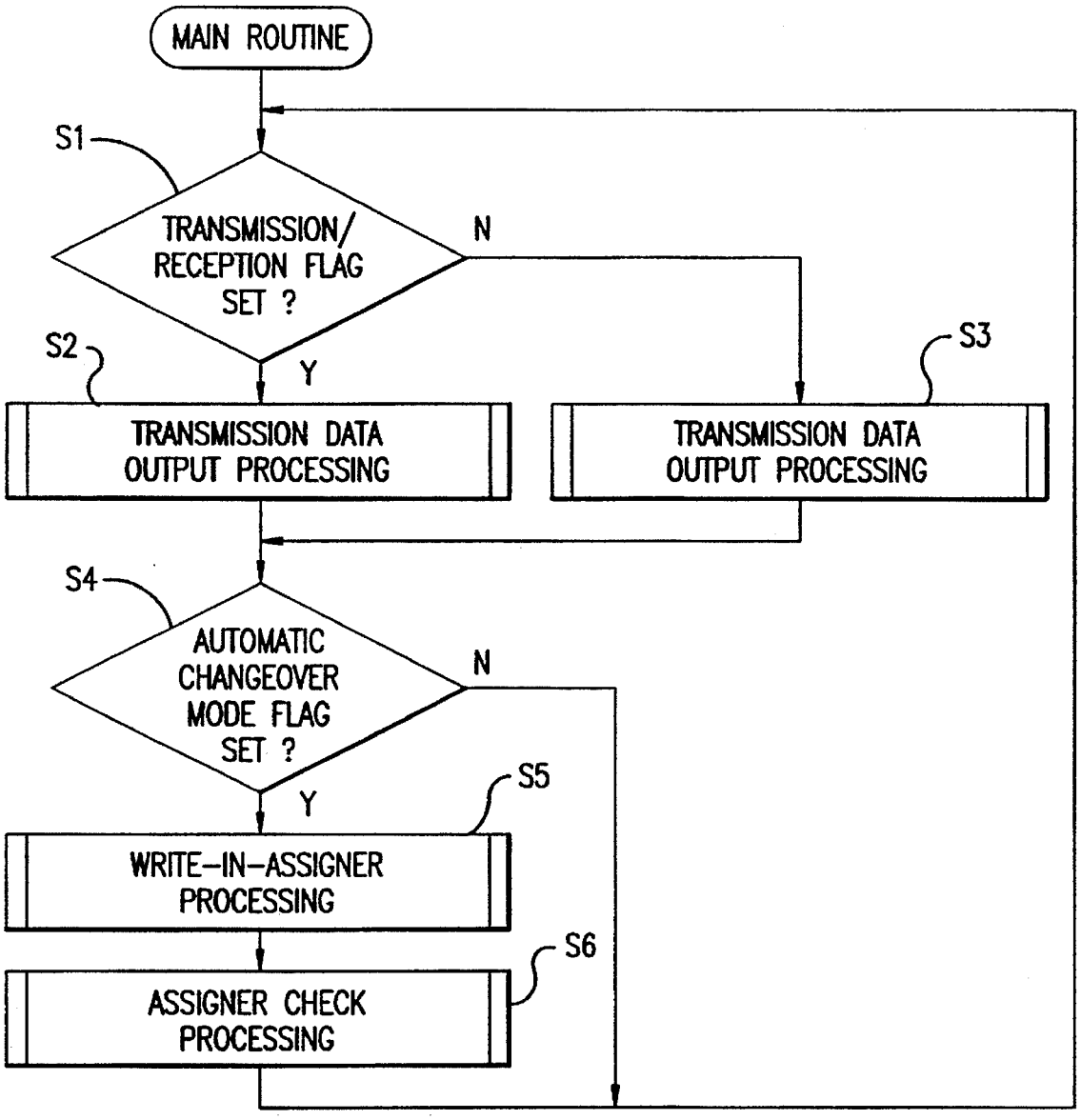
FIG. 4 is a flowchart of a main routine executed by the MIDI signal transmitter/receiver.

Next, the main routine for controlling the operation of the transmitter/receiver 3 will be described with reference to FIG. 4.

Figure 5A:
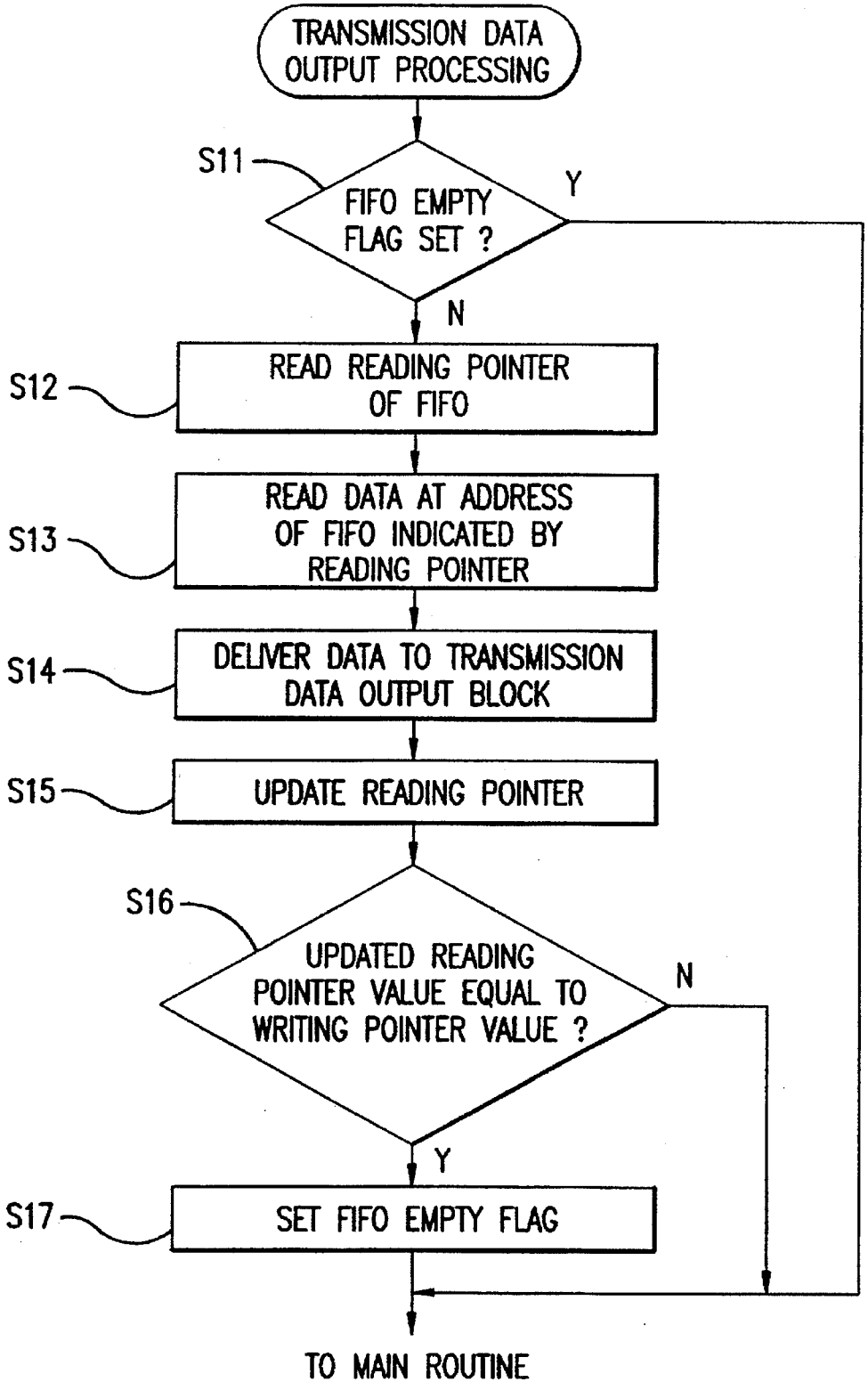
FIG. 5A is a flowchart of transmission data output processing.
Figure 5B:
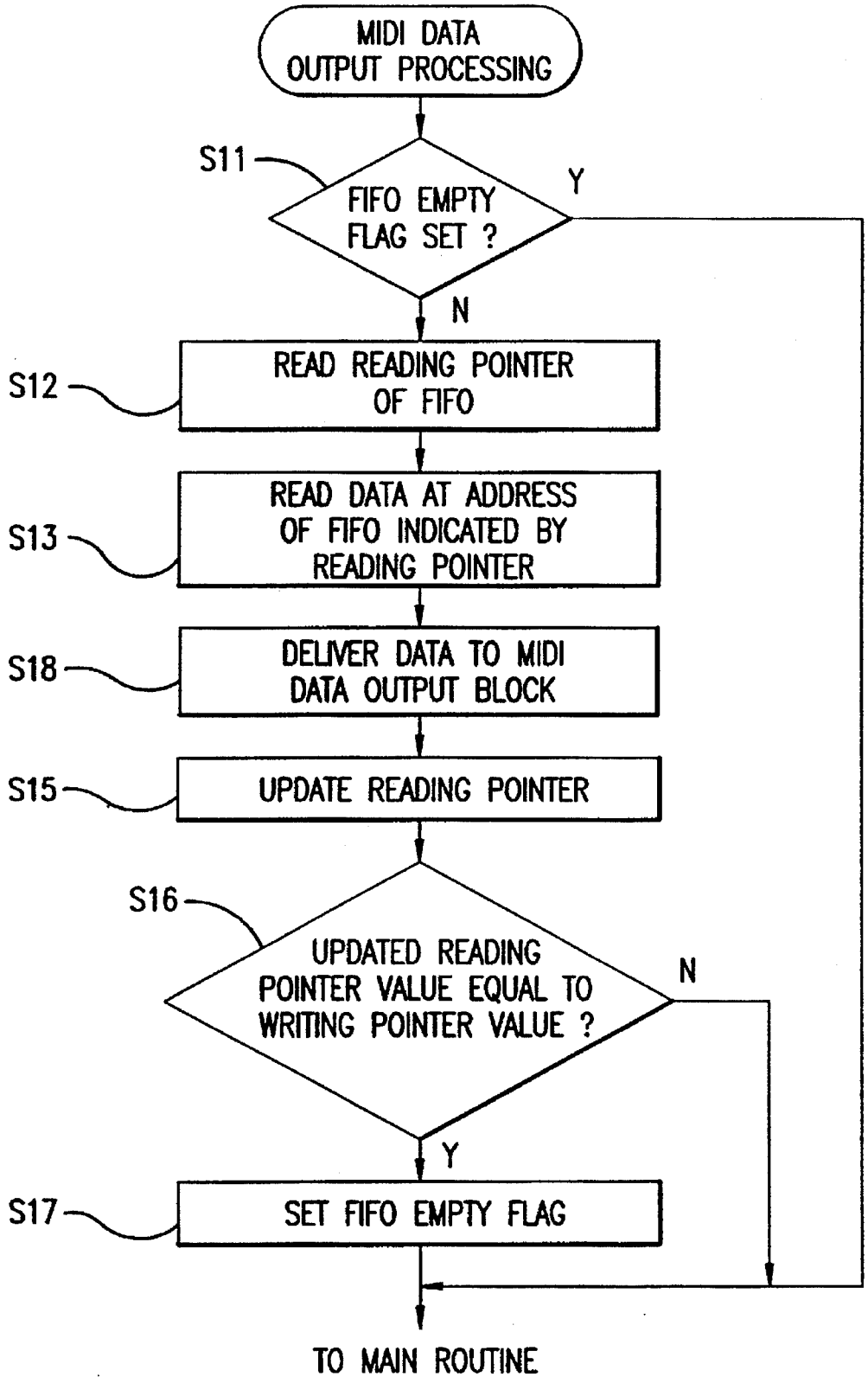
FIG. 5B is a flowchart of MIDI data output processing.

The main routine is constantly repeatedly carried out. In this routine, first at a step S1, it is determined whether or not the transmission/reception flag is set. If the transmission/reception flag is set, i.e. if the transmitter mode switch has been turned on in the manual mode, or if the transmitter/receiver 3 is in the transmitter mode when it is set to the automatic changeover mode, the program proceeds to a step S2, where the transmission data output processing, described in detail hereinafter with reference to FIG. 5A, is carried out. If the transmission/reception flag is not set, i.e. if the transmission switch has not been turned on when the transmitter/receiver is in the manual mode, or if the transmission/receiver is not in the transmitter mode when it is set to the automatic changeover mode, the program proceeds to a step S3, where the MIDI data output processing, described in detail hereinafter with reference to FIG. 5B, is carried out.

After the processing of the step S2 or the step S3 is carried out, it is determined at a step S4 whether or not the automatic changeover mode is set. When the automatic changeover mode is set, i.e. if the transmitter/receiver 3 is in the automatic changeover mode, write-in assigner processing and assigner check processing, both described in detail hereinafter with reference to FIG. 9 to FIG. 11, and FIG. 12, are carried out at steps S5 and S6, respectively. Then, the program returns to the step S1 to repeatedly carry out the main routine. If the answer to the question of the step S4 is negative, i.e. if the transmitter/receiver 3 is in the manual mode, the program immediately returns to the step S1, to repeatedly execute the main routine.

Next, the transmission data output processing carried out at the step S2 of the main routine will be described in detail with reference to FIG. 5A. In this processing, MIDI data received from the keyboard (main part) 2 is transmitted to the other keyboard 2. First, at a step S11, it is determined whether or not the FIFO empty flag is set. If the FIFO empty flag is set, i.e. if no MIDI data is stored in the FIFO memory, this routine is immediately terminated, followed by the program returning to the main routine.

If the answer to the question of the step S11 is negative (NO), i.e. if the FIFO empty flag is not set, i.e MIDI data exists in the FIFO memory, a value of the reading pointer of the FIFO memory is read at a step S12, and the MIDI data stored at the address of the FIFO memory indicated by the reading pointer is read at a step S13. Then, the MIDI data read out from the FIFO memory is delivered to the transmission data output block 17 at a step S14, and the reading pointer is updated at a step S15. Then, it is determined at a step S16 whether or not the updated value of the reading pointer is equal to a value of the writing pointer. If the former is equal to the latter, it is Judged that no MIDI data remains in the FIFO memory, and the FIFO empty flag is set at a step S17, followed by the program returning to the main routine. On the other hand, if the answer to the question of the step S16 is negative (NO), it is judged that MIDI data remains within the FIFO memory, and the program returns to the main routine without setting the FIFO empty flag.

Then the MIDI data output processing carried out at the step S3 of the main routine will be described with reference to FIG. 5B. In this processing, the MIDI data received from the other keyboard 2 is delivered to the keyboard (main part) 2. This processing is similar to the transmission data output processing described above, and is distinguished therefrom in that the step S14 is replaced by a step S18, at which the MIDI data read out from the FIFO memory is not delivered to the transmission data output block 17 but to the MIDI data output block 20. In short, according to this processing, the MIDI data read out is sent to the MIDI data output block 20, thereby delivering the MIDI signal to the keyboard (main part) 2.

Figure 6:
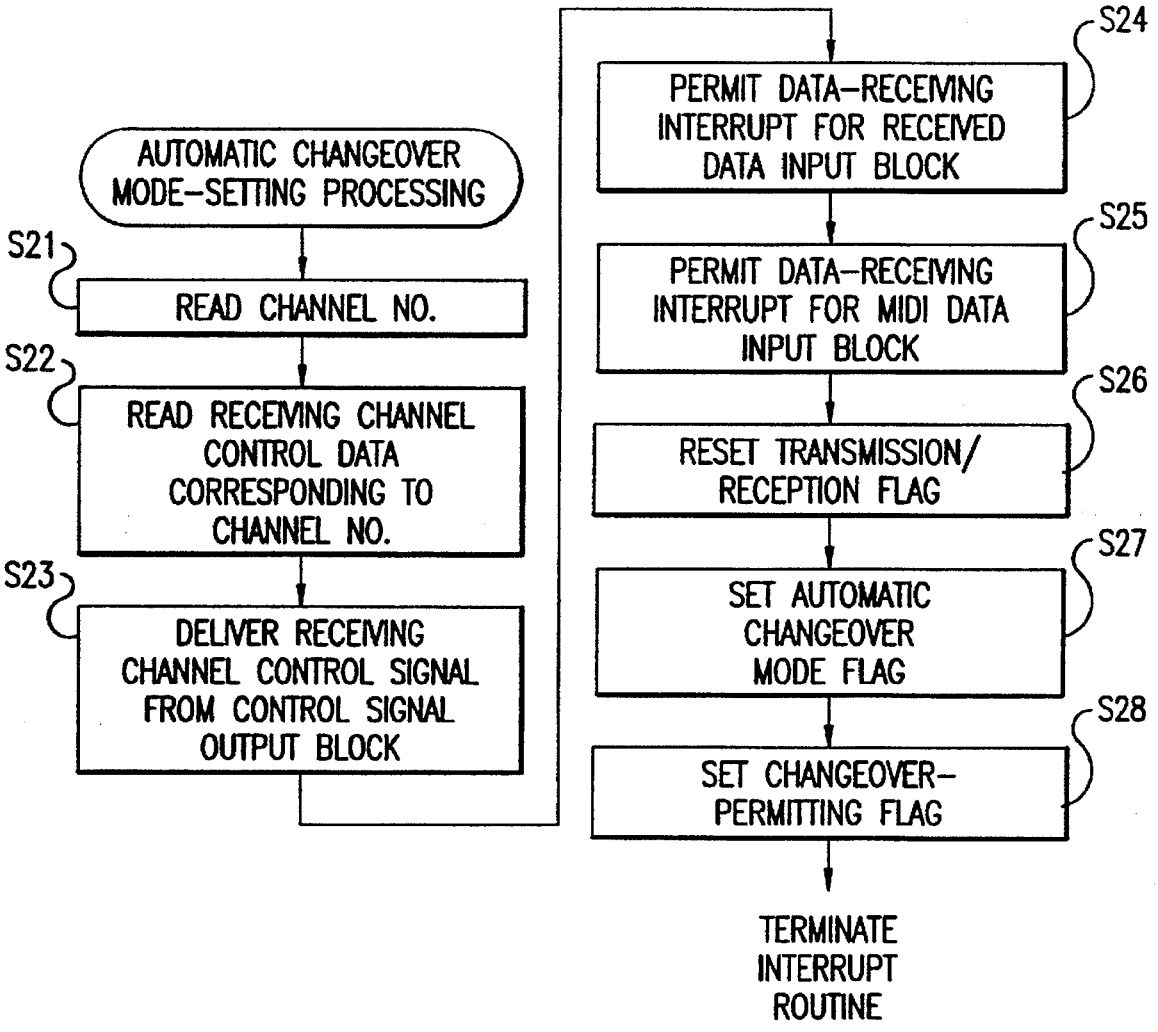
FIG. 6 is a flowchart of automatic changeover mode-setting processing.

Then, the automatic changeover mode-setting processing will be described with reference to FIG. 6. According to this routine, when the automatic changeover mode switch is depressed or tuned on, the transmitter/receiver 3 is set to the automatic changeover mode by interrupt processing, while setting or resetting all the flags except for the FIFO empty flag, to respective predetermined states.

First, a channel number designated by the channel switch is read at a step S21, the receiving channel control data corresponding to the channel number (i.e. data of the first local oscillation frequency of the VCO 44 in the receiver mode) is read from the control data memory block 12 at a step S22. Then, a receiving channel control signal based on the receiving channel control data is delivered via the control signal output block 16 to the transmitter/receiver 18 at a step S23. In this state, the received data input block 19 is enabled to receive the data from the transmitter/receiver block 18, and the received data input interrupt by the received data input block 19 is permitted at a step S24.

Further, in this state, the MIDI data input block 14 is also enabled to receive MIDI data, and hence the MIDI data input interrupt by the MIDI data interrupt block 14 is also permitted at a step S25.

Further, the transmission/reception flag is reset at a step S26 to set the transmitter/receiver 3 to the receiver mode at a step S26, the automatic changeover mode flag is set at a step S27, and the changeover-permitting flag is set at a step S28. This terminates the automatic changeover mode-setting routine, and the program returns to the main routine.

Figure 7:
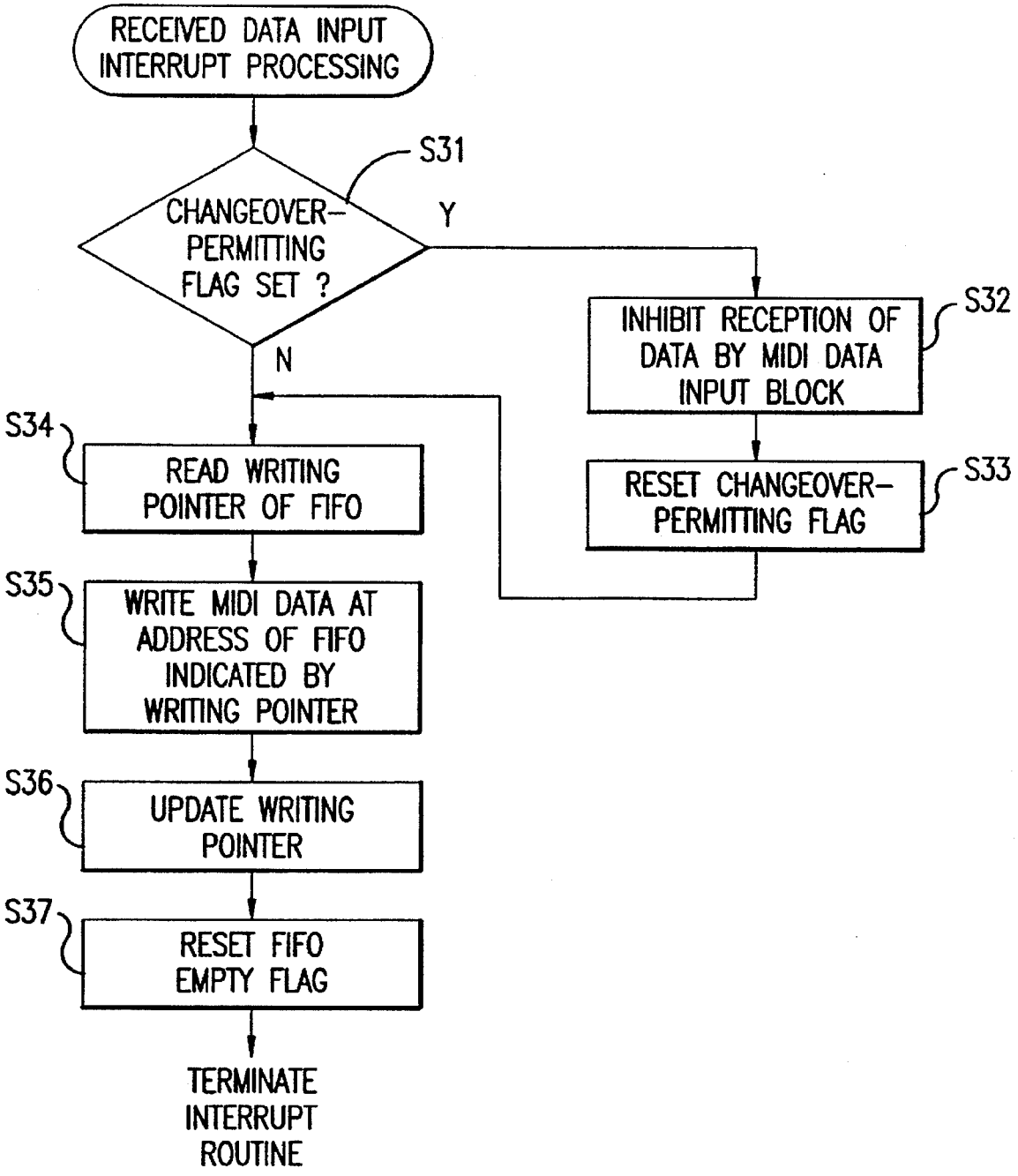
FIG. 7 is a flowchart of received data input interrupt processing.
Figure 8:
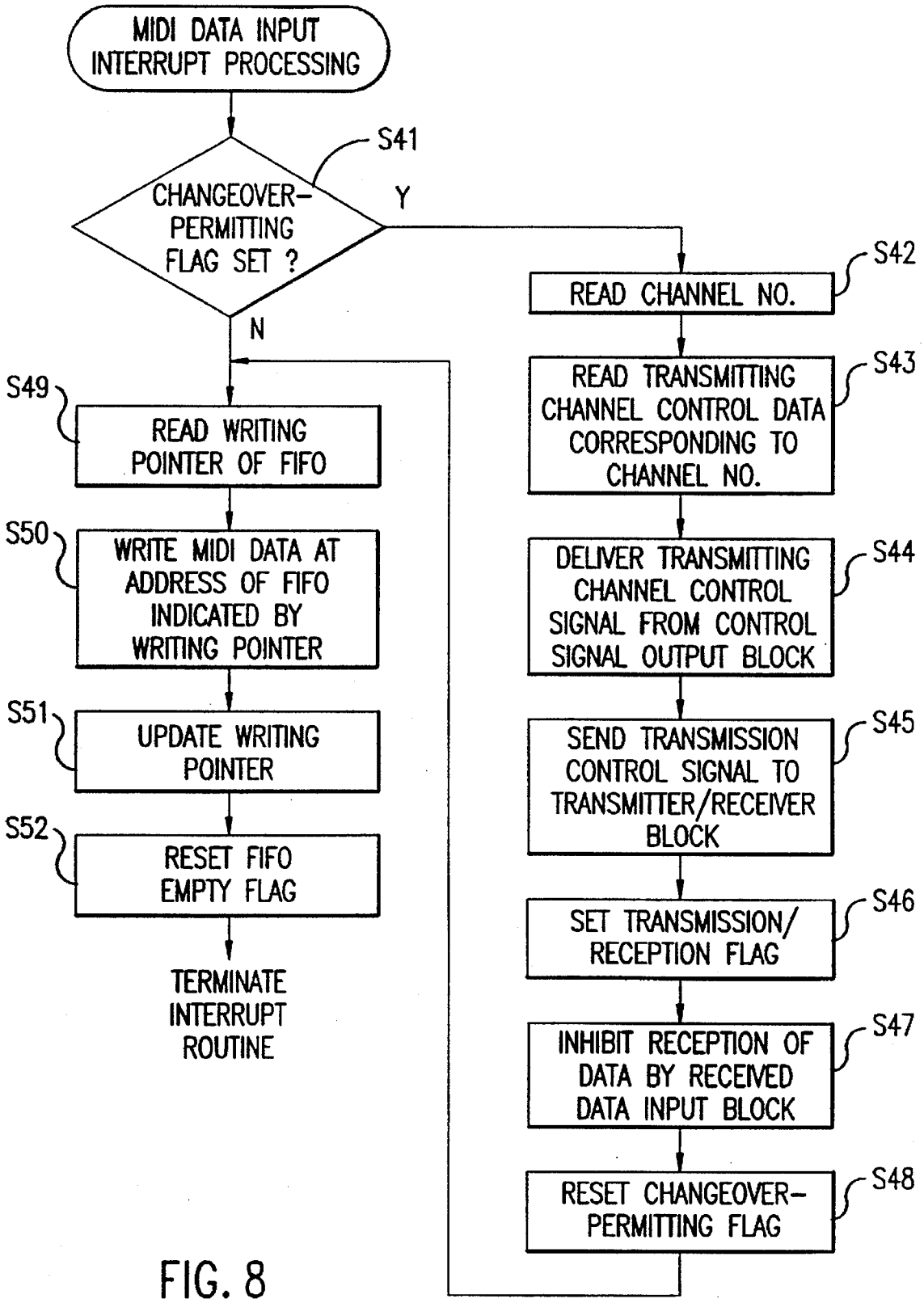
FIG. 8 is a flowchart of MIDI data input interrupt processing.

Then, interrupt processing for receiving data via the received data input block (received data input interrupt processing) and interrupt processing for receiving data via the MIDI data input block (MIDI data input interrupt processing) will be described with reference to FIG. 7 and FIG. 8. It should be noted that these interrupt processings are also carried out in manual receiver mode-setting processing and manual transmitter mode-setting processing, both described in detail hereinbelow with reference to FIG. 14A and FIG. 14B, respectively.

First, the received data input interrupt processing will be described. According to this processing, when the transmitter/receiver 3 is in the receiver mode, the MIDI signal received via the transmitter/receiver block 18 and the received data input block 19 from the other keyboard 2 is automatically delivered to the keyboard (main part) 2. In this processing, it is first determined at a step S31 whether or not the changeover-permitting flag is set. If the answer to this question is affirmative (YES), i.e. if the transmitter/receiver 3 is in the standby state, the MIDI data input block 14 is inhibited from receiving data at a step S32, and the changeover-permitting flag is reset at a step S33. After the resetting, or if the answer to the question of the step S31 is negative (NO), i.e. if the received data input interrupt processing is already being carried out, the writing pointer of the FIFO memory is read at a step S34, and the MIDI data received via the received data input block 19 is written into the FIFO memory at the address indicated by the writing pointer at a step S35. Then, the writing pointer is updated at a step S36, followed by resetting the FIFO empty flag at a step S37. This terminates the received data input interrupt processing, and the program returns to the main routine.

Then the MIDI data input interrupt processing will be described in detail with reference to FIG. 8. According to this processing, When the transmitter/receiver 3 is in the transmitter mode, the MIDI signal received via the MIDI data input block 14 from the keyboard (main part) 2 is automatically transmitted to the other keyboard 2. In this processing, it is first determined at a step S41 whether or not the changeover-permitting flag is set. If the answer to this question is affirmative (YES), i.e. if the transmitter/receiver 3 is in the standby state, a channel number designated by the channel switch is read at a step S42, and transmitting channel control data corresponding to the channel number (i.e. data of the first local oscillation frequency of the VCO 44 in the transmitter mode) is read from the control data memory block 12 at a step S43. Then, the transmitting channel control signal based on the transmitting channel control data is delivered via the control signal output block 16 to the transmitter/receiver block 18 at a step S44, while the transmission control signal is delivered to the transmitter/receiver block 18 via the control signal output block 16 at a step S45. Thereafter, the transmission/reception flag is set at a step S46, the received data input block 19 is inhibited from receiving data at a step S47, and the changeover-permitting flag is reset at a step S48.

After this flag is reset, or if the answer to the question of the step S41 is negative (NO), i.e. if the MIDI data input interrupt is already being carried out, the writing pointer of the FIFO memory is read out at a step S49, and the MIDI data received via the MIDI data input block 14 is written into the FIFO memory at the address designated by the writing pointer at a step S50. Then, the writing pointer is updated at a step S51, and the FIFO empty flag is reset at a step S52. This terminates the MIDI data input interrupt processing, and the program returns to the main routine.

As described above, by the received data input interrupt processing and the MIDI data input interrupt processing, it is possible to determine from which of the keyboard (main part) 2 and the other keyboard 2 is the MIDI data received, and according to the results of the detection, the MIDI data based on the MIDI signal is automatically delivered to the keyboard (main part) or transmitted to the other keyboard 2, which dispenses with changeover operation for switching between the use of the receiver block 33 and the use of the transmitter block 34.

Further, by writing the MIDI data into the FIFO memory once at the step S35 or S50, the FIFO memory serves as a buffer to adjust a difference, if any, between a transmission speed of the MIDI signal received from the keyboard (main part) 2, and a transmission speed of data transmitted from the transmitter block 34, or a difference, if any, between a transmission speed of the MIDI signal received from the other keyboard 2, and a transmission speed of MIDI signal delivered from the MIDI data output block to the keyboard (main part) 2.

Figure 9:
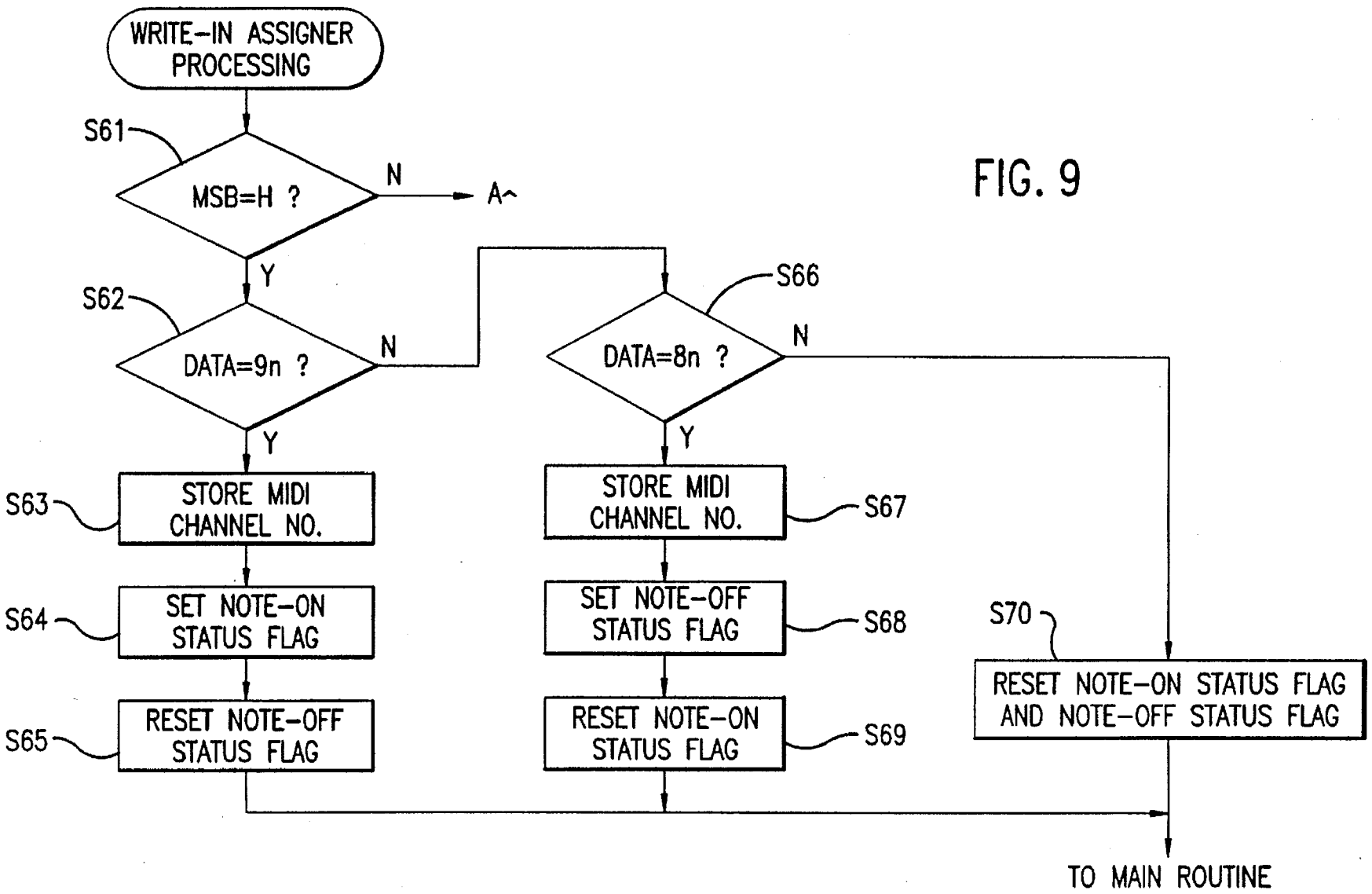
FIG. 9 is a flowchart of write-in assigner processing.
Figure 10:
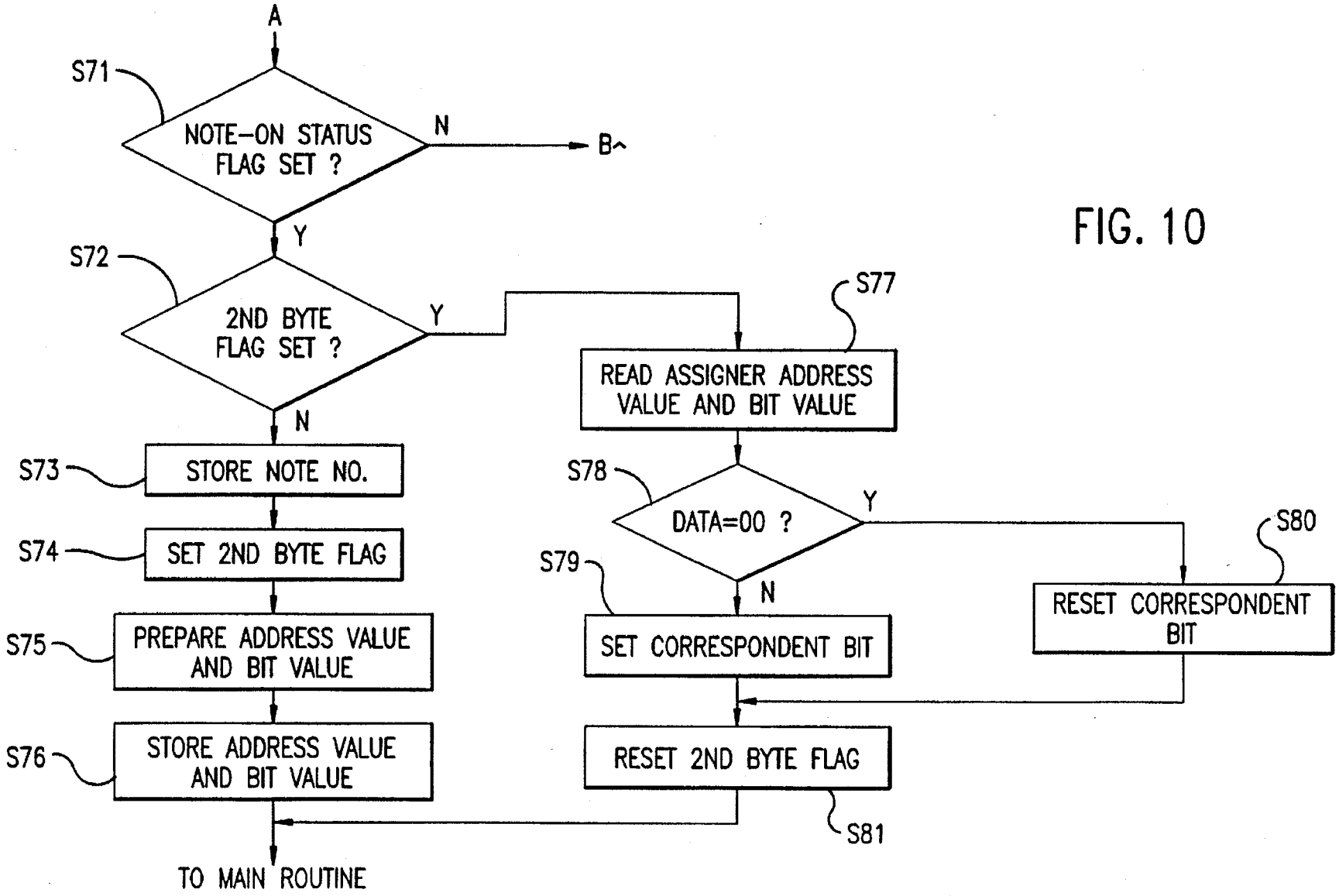
FIG. 10 is a continuation of the FIG. 9 flowchart.

Next, the write-in assigner processing carried out at the step S5 of the main routine will be described with reference to FIG. 9 to FIG. 11. According to this processing, data of note-on keys of the keyboard 2 concerning MIDI channel is written into the assigner 21 after one byte of MIDI data based on a MIDI signal is transmitted at the step S2 or delivered to the keyboard (main part) at the step S3.

First, MIDI data received via the MIDI data input block 14 or the received data input block 19 is checked as to whether the MSB (Most Significant Bit) thereof is "H", i.e. equal to "1" at a step S61. If the answer to this question is negative (NO), i.e. if the MIDI data is a data byte, the program proceeds to a step S71 shown in FIG. 10, whereas if the answer is affirmative (YES), i.e. if the MIDI data is a status byte, it is determined at a step S62 whether or not the more significant four bits is equal to 9n, i.e. whether they are "1001". If the answer is affirmative (YES), it is judged that the MIDI data designates a note-on status, and a MIDI channel number is stored at a step S63. Then, the note-on status flag is set at a step S64, while resetting the note-off status flag at a step S65, to thereby prevent the note-on status flag and the note-off status flag from being both set simultaneously, followed by returning to the main routine.

If the answer to the question of the step S62 is not equal to "9n", it is determined at a step S66 whether or not the more significant four bits is equal to 8n, i,e. whether or not they are "1001. If the answer to this question is affirmative (YES), i.e. if the MIDI data designates a note-off status, a MIDI channel number is stored at a step S67, and the note-off status flag is set at a step S68, while resetting the note-on status flag at a step S69. In this case as well, the flags are prevented from being both set simultaneously. If the answer to the question of the step S66 is negative (NO), it means that the present MIDI data represents neither the note-on status nor the note-off status, and hence the note-on status flag and the note-off status flag are reset, at a step S70, followed by the program returning to the main routine.

The processing carried out when the answer to the question of the aforementioned step S61 is negative (NO), i.e. when the MIDI data is a data byte will be described with reference to FIG. 10. This program is executed when the input MIDI data is a data byte. First, it is determined at the step S71 whether or not the note-on status flag is set, i.e. whether or not the note-on status flag has been set at the step S64 in FIG. 9.

Figure 11:
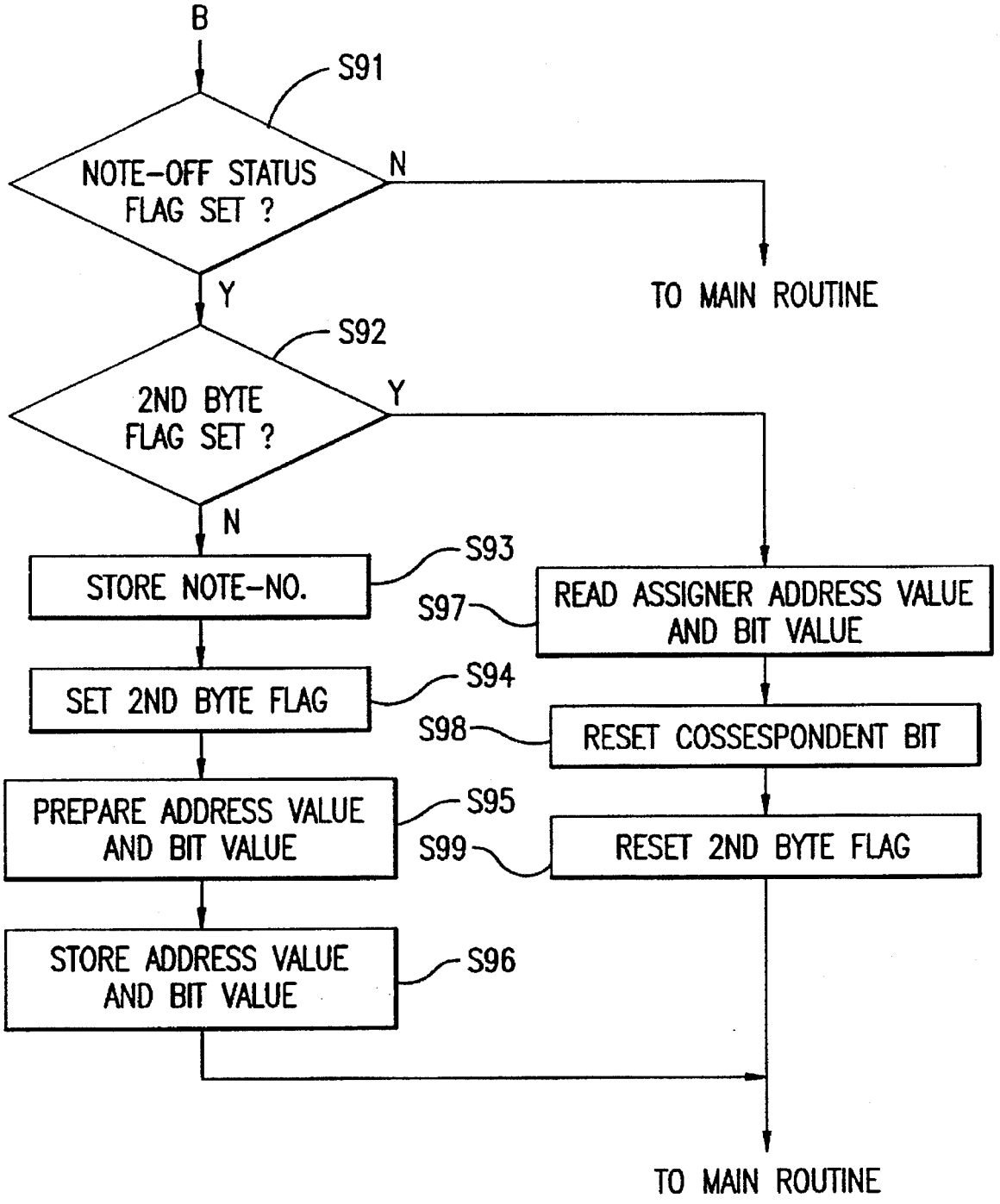
FIG. 11 is a continuation of the FIG. 10 flowchart.

If it is determined that the note-on status flag is not set, i.e. if the MIDI data received is not note-on data, the program proceeds to a step S91 shown in FIG. 11, whereas if the answer is affirmative (YES), it is determined at a step S72 whether or not a second byte flag is set, i.e. whether or not the MIDI data is data of the second byte. If the answer to this question is negative (NO), i.e. if the MIDI data received is the second byte data of the MIDI data, the note number is stored at a step S73, and the second byte flag is set at a step S74. Then, from the MIDI channel number stored at the step S63 and the note number stored at the step S73, the address value and the bit value for the assigner 21 are prepared at a step S75, and then stored at a step S76. This makes it possible to check to which key of which MIDI channel corresponds data of the third byte to be received next.

On the other hand, if the answer to the question of the step S72 is affirmative (YES), i.e. if the second byte flag is set, i.e. if the MIDI data received is data of the third byte, the address value and bit value of the assigner 21 are read out at a step S77. Then, it is determined at a step S78 whether or not the data is "00 (volume 0)", i.e. if it designates a note-off. If the answer to this question is negative (NO), a correspondent bit (memory area) of the assigner 21 is set, i.e. "1" is written therein to set the note-on status, at a step S79. If the answer is affirmative (YES), a correspondent bit of the assigner 21 is reset, i.e. "0" is written therein, and the second byte flag is reset at a step S81, followed by the program returning to the main routine.

Now description will be made with reference to FIG. 11 on the case in which the answer to the question of the step S71 is negative (NO), i.e. the note-on status flag is not set, in other words, the MIDI data received is not the note-on data. If the data other than the note-on data is received, it is determined at a step S91 whether or not the note-on status flag is set. If the note-off status flag is not set, i.e. if the data received is neither the note-on data nor the note-off data, it is judged that performance data other than the note data is received, followed by the program returning to the main routine.

If the note-off status flag is set, it is determined at a step S92 whether or not the second byte flag is set. If the answer to this questions negative (NO), the note number is stored at a step S93, and the second byte flag is set at a step S94. Then, from the MIDI channel number stored at the step S63 and the note number stored at the step S93, the address value and the bit value for the assigner 21 are prepared at a step S95, and at the same time stored at a step S96. This makes it possible to determine to which key of which MIDI channel corresponds data of the third byte to be received next.

On the other hand, if the answer to the question of the step S92 is affirmative (YES), the address value and bit value of the assigner 21 are read out at a step S97. Then, a corresponding bit of the assigner is reset, i.e. "0" is written therein at a step S98, and the second byte flag is reset at a step S99. In short, it is assumed here that the key which was set to the note-on status, is changed into the note-off status. This completes the assigner processing, and the program returns to the main routine.

Figure 12:
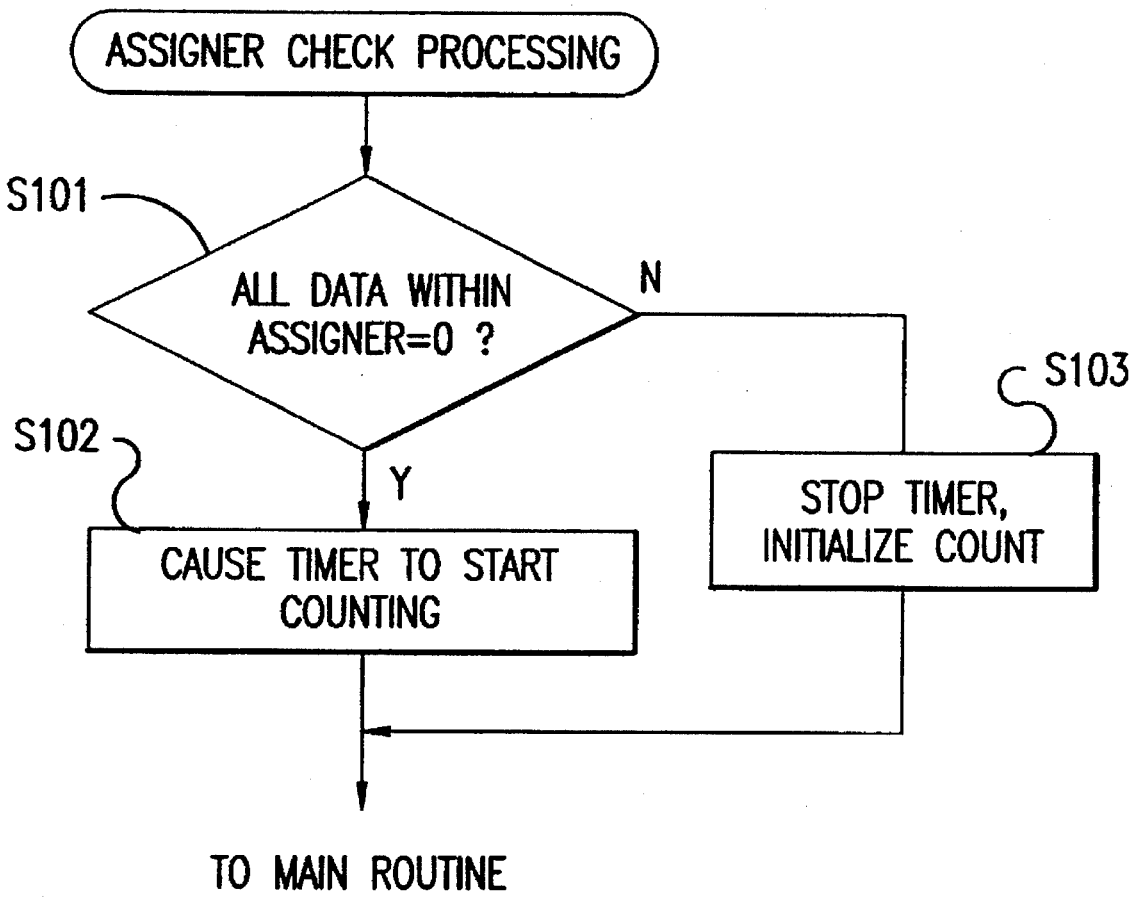
FIG. 12 is a flowchart of assigner check processing.

Next, the assigner check routine carried out at the step S6 of the main routine will be described with reference to FIG. 12.

If the write-in assigner processing at the step S5 of the main routine is terminated, it is determined at a step S101 whether or not all the data within the assigner is equal to "0". This check is made to determine whether or not all the MIDI data received via the MIDI data input block 14 or the MIDI data received via the received data input block 19 have been delivered via the MIDI data output block 20 to the keyboard (main part) 2, or transmitted to the other keyboard via the transmitter/receiver block 18, setting all the keys within the MIDI channel off. If all the data within the assigner 21 are equal to "0", a timer incorporated within the CPU 11 is started at a step S102. When the count of the timer becomes equal to a predetermined number (i.e. if a predetermined time period, e.g. 1 or 2 seconds elapses), the timer interrupt, described hereinbelow, is carried out. On the other hand, if all the data within the assigner are not equal to "0", the timer is stopped and the count thereof is initialized at a step S103.

Figure 13:
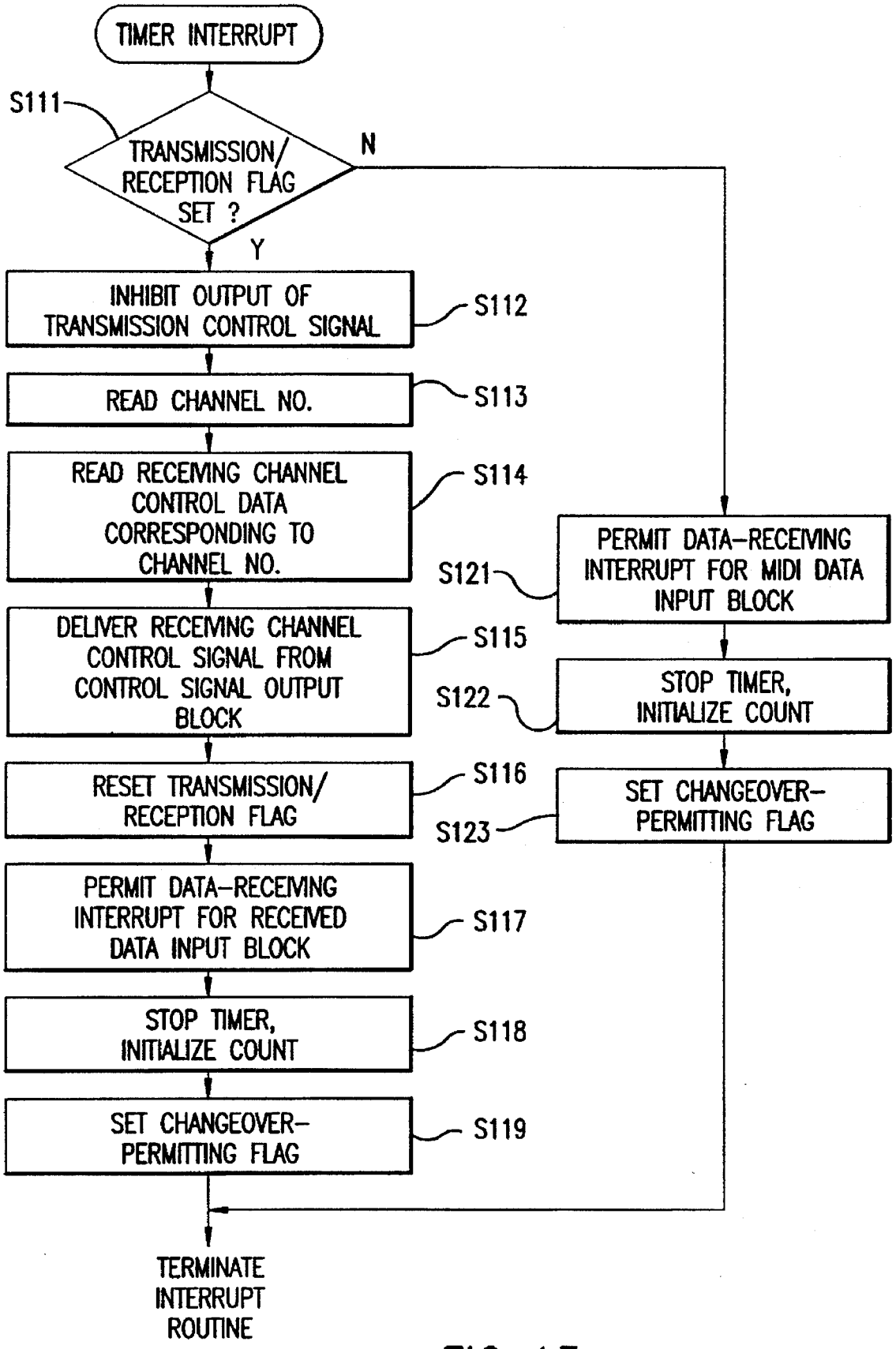
FIG. 13 is a flowchart of timer interrupt processing.

Then, the timer interrupt processing carried out when the timer runs out at the step S102 in FIG. 12 will be described with reference to FIG. 13.

The timer interrupt processing resets the transmitter/receiver 3 to the initial state of the automatic changeover mode when the received data input interrupt or the MIDI data input interrupt is carried out and terminated in the automatic changeover mode. In other words, when the assigner 21 does not store the MIDI data for a predetermined time period, it automatically sets the transmitter/receiver 3 to a state which permits the received data input interrupt processing and the MIDI data input interrupt processing.

In this processing, it is determined at a step S111 whether or not the transmission/reception flag is set. If the answer to this question is affirmative (YES), the output of the transmission control signal is inhibited at a step S112, i.e. the transmitter/receiver block 18 is set to a data-receiving status, and then the channel number designated by the channel number switch is read at a step S113. The receiving channel control data corresponding to the channel number is read from the control data storage block 12 at a step S114. Then, the receiving channel control data read is delivered to the transmitter/receiver block 18 by way of the control signal output block 16 at a step S115. Then, the transmission/reception flag is reset at a step S117, thereby setting the received data input block 19 to a state in which data can be received, and the received data input interrupt is permitted at a step S117. Then, the counting of the timer at the step S102 of the assigner check processing carried out at the step S6 of the main routine is stopped, and the count of the timer is initialized at a step S118. Then, the changeover-permitting flag is set at a step S119.

If the answer to the question of the step S111 is negative (NO), i.e. if the MIDI data input block 14 is already set to a state in which data can be received, the MIDI data input interrupt is permitted at a step S121. Then, similarly to the step S118, the counting of the timer is stopped, and the count of the same is initialized at a step S122. Then, the changeover-permitting flag is set at a step S123. This terminates the timer interrupt processing, and the program returns to the main routine.

As described above, in the timer interrupt processing, when it is determined that no note-on data is stored in the assigner 21, the operation of the transmitter block 34 is inhibited (the transmitter mode is canceled), and the receiver block 33 is made operative (the receiver mode is set at the step S122). Then, the received data input interrupt is permitted at the step S117, and the MIDI data input interrupt is permitted at the step S121. This automatically makes it possible to input the MIDI signal from the keyboard (main part) 2 to the transmitter/receiver 3, which in turn transmits the MIDI signal via the transmitter block 34 to the other keyboard, and also to deliver the MIDI signal received via the receiver block 3 to the keyboard (main part) 2.

Further, the timer count processing provides an extra time period when the keyboard (main part) 2 or the other keyboard immediately starts delivery or transmission of the MIDI data when all the data in the assigner becomes equal to "0", which makes it possible to reliably transmit all the MIDI signals from the keyboard (main part) 2 and the MIDI signal received from the other keyboard 2, to the other keyboard 2 and the keyboard (main part) 2, respectively.

Figure 14A:
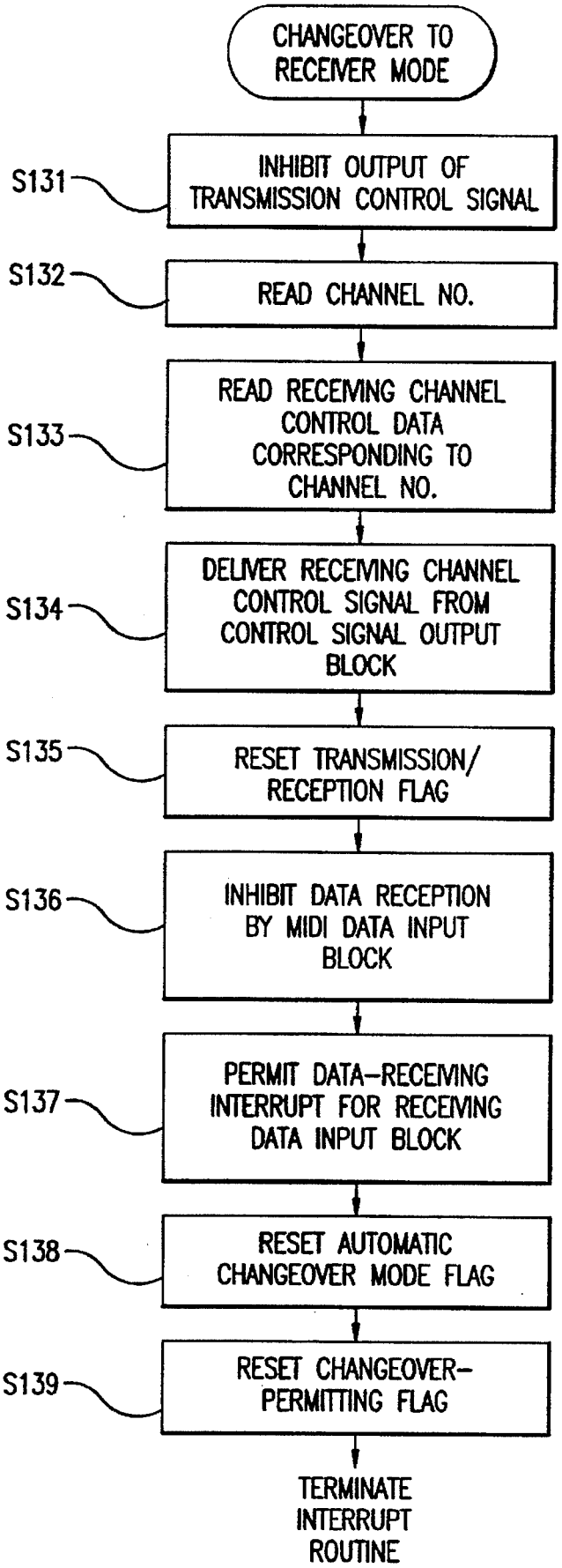
FIG. 14A is a flowchart of manual receiver mode-setting processing.
Figure 14B:
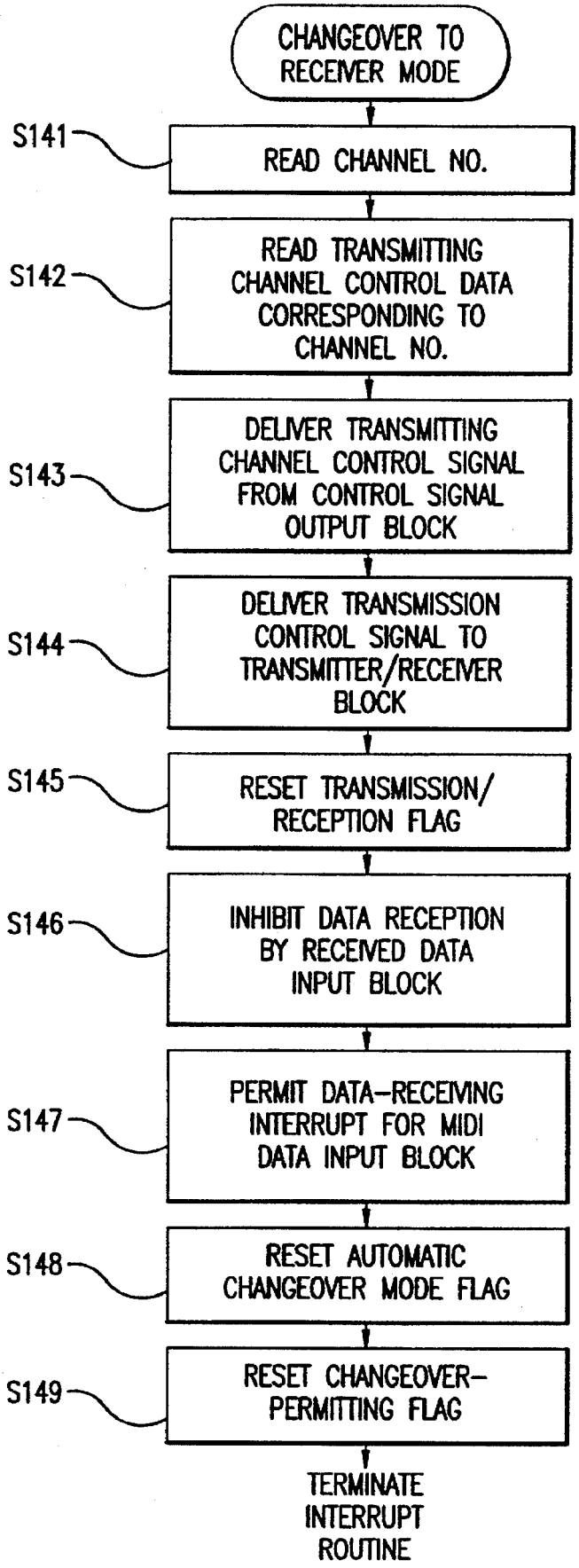
FIG. 14B is a flowchart of manual transmitter mode-setting processing.

Next, the processing (manual receiver mode-setting processing) of changeover to receiver mode and the processing of changeover to transmitter mode (manual transmitter mode-setting processing) in the manual mode will be described with reference to FIG. 14A and FIG. 14B.

First, the processing of changeover to receiver mode in the manual mode will be described with reference to FIG. 14A. This processing is carried out, when the automatic changeover mode switch is turned off to set the transmitter/receiver 3 to the manual mode, and at the same time the receiver mode switch is turned on to set the same to the receiver mode, thereby using the keyboard 2 exclusively as a tone generator. In short, this processing is executed when the keyboard 2 is caused to give a performance in response to the MIDI signal received from the other keyboard 2.

According to this processing, when the on-status of the receiver mode switch is detected, the transmission control signal is inhibited from being delivered at a step S131, and the transmitter/receiver block 18 is set to the receiver mode and at the same time the channel number designated by the channel switch is read at a step S132. Then, the receiving channel control data corresponding to the channel number is read from the control data storage block 12 at a step S133. Then, the receiving channel control signal based on the receiving channel control data is delivered via the control signal output block 16 to the transmitter/receiver block 18 at a step S134. Then, the transmission/reception flag is reset at a step S135 to make the transmitter/receiver block 18 capable of receiving data, and at the same time, the MIDI data input block 14 is inhibited from receiving the MIDI data at a step S136. In this state, the received data input block 19 alone is permitted to receive the data, and the received data input interrupt is permitted at a step S137. Then, the automatic changeover mode flag is reset at a step S138, to set the transmitter/receiver to the manual mode, and at the same time the changeover-permitting flag is reset at a step S139, followed by the program returning to the main routine.

Next, the processing of changeover to transmitter mode in the manual mode will be described with reference to FIG. 14B. This processing is carried out, when the automatic changeover mode switch is turned off to set the transmitter/receiver 3 to the manual mode, and at the same time the transmitter mode switch is turned on to set the same to the transmitter mode, thereby setting the transmitter/receiver 3 to a predetermined state in which the present keyboard 2 causes the other keyboard 2 to give a performance in response to the MIDI signal transmitted therefrom. Further, this processing is substantially similar to the processing of changeover to the receiver mode in the manual mode described above, and is distinguished therefrom only in that the transmitter/receiver block 18 is set not to a data-receiving status, but to a data-transmitting status, in short, in delivery of the transmission control signal from the control signal output block 16.

In this processing, the channel number is read at a step S141. Then, the transmitting channel control data corresponding thereto is read from the control data storage block 12 at a step S142. Then, the transmitting channel control signal based on the transmitting channel control data is delivered via the control signal output block 16 to the transmitter/receiver block 18 at a step S143. Then, the transmission control signal is delivered at a step S144, and the transmission/reception flag is set at a step S145. Then, the received data input block 19 is inhibited from receiving the MIDI data at a step S146. In this state, the MIDI data input block 14 alone is permitted to receive data, and the MIDI data input interrupt is permitted at a step S147. Then, the automatic changeover mode flag is reset at a step S148, to set the transmitter/receiver to the manual mode, and at the same time the changeover-permitting flag is reset at a step S149, followed by terminating the processing of changeover to transmitter mode.

As described above, when in the manual mode, by selective operation of the transmitter mode switch and the receiver mode switch, the operation of the transmitter/receiver 3 can be easily set to one of the transmitter mode and the receiver mode. Therefore, it is possible to use the keyboard 2 as a single or isolated MIDI performance device, or as a tone generator controlled by the other keyboard 2. Further, it can be used as a tone generation control device for controlling the tone generation by the other keyboard 2. In this case, it is quite unnecessary to change connections of MIDI cables and transmitter/receivers 3.

Figure 15A:
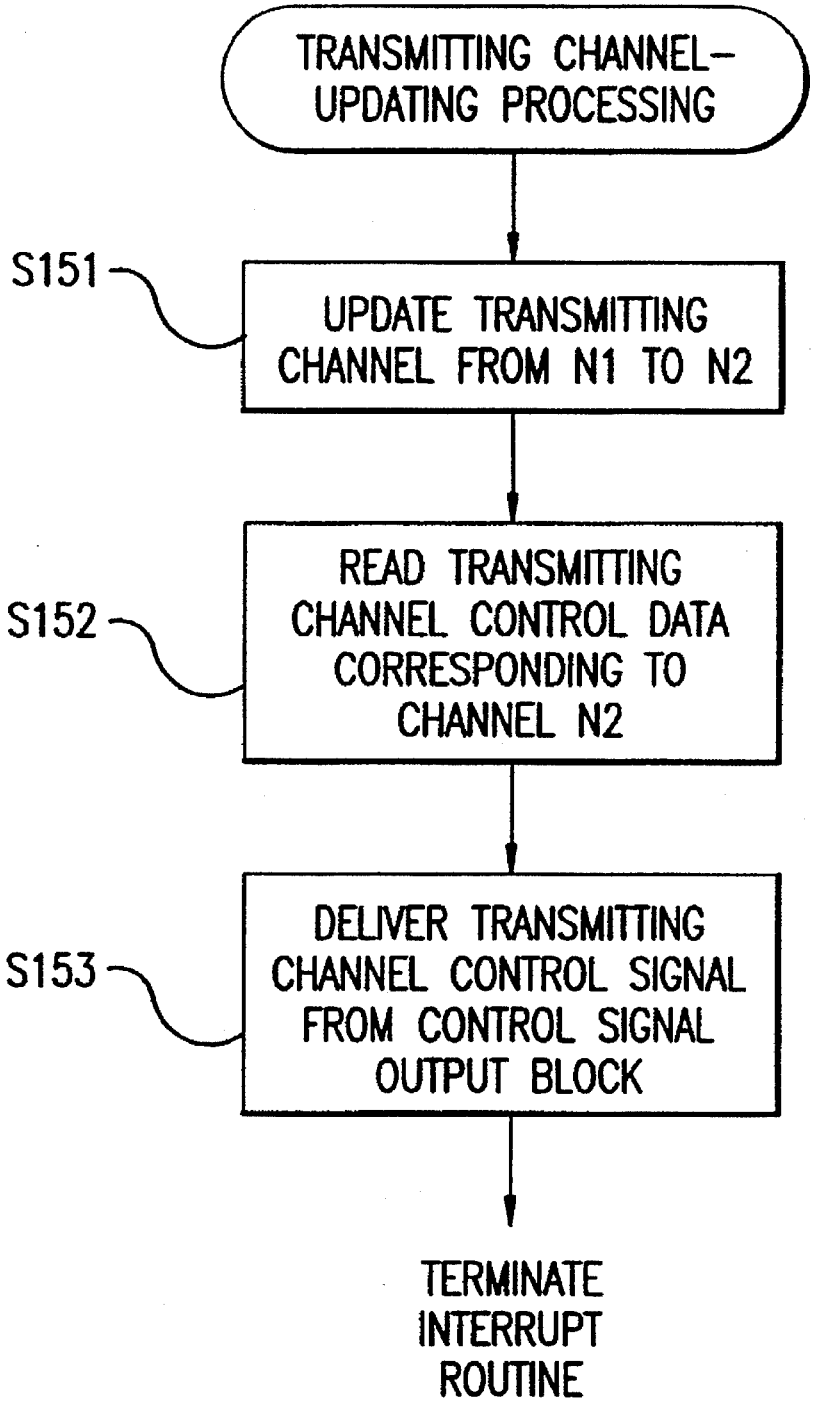
FIG. 15A is a flowchart of transmitting channel-updating processing.
Figure 15B:
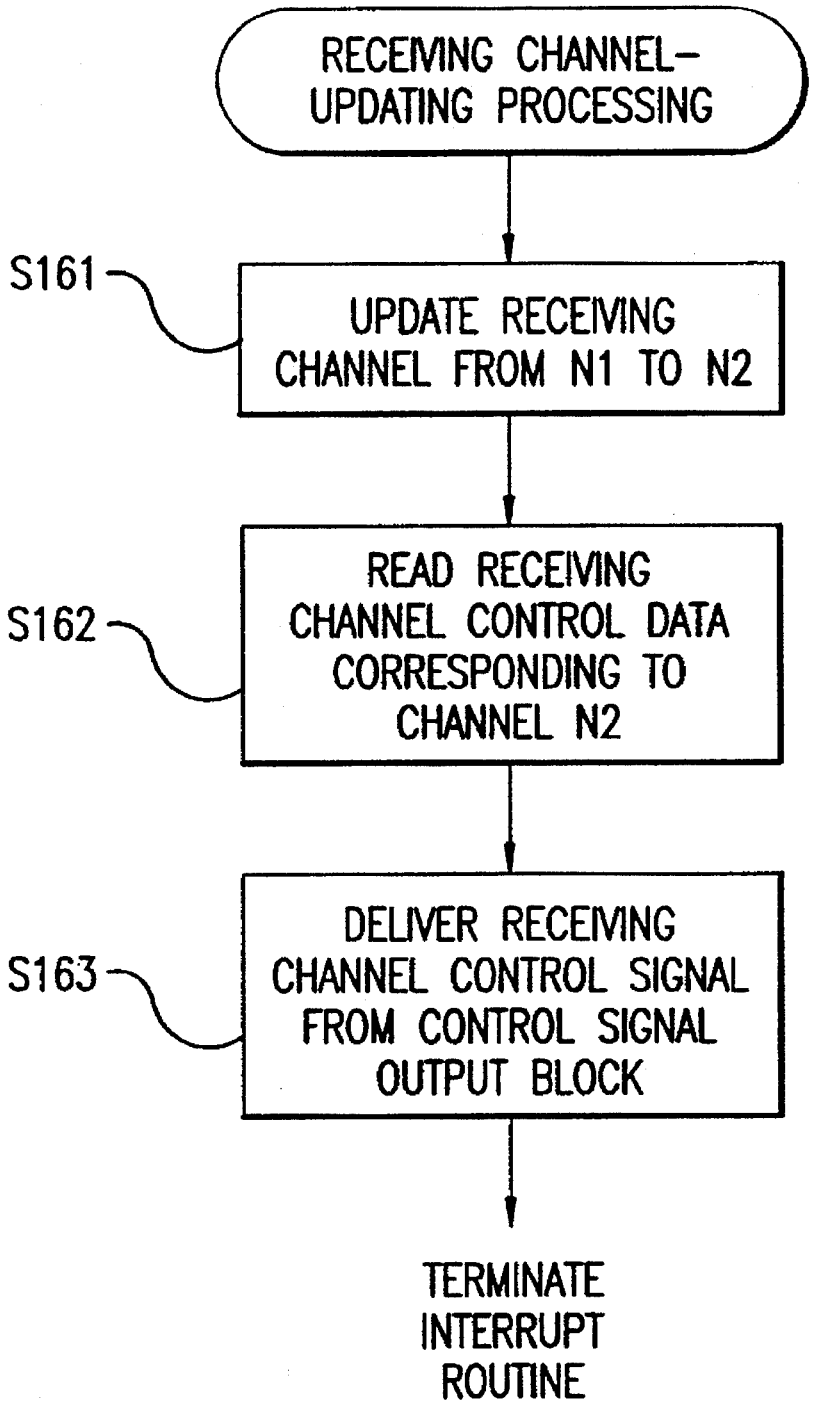
FIG. 15B is a flowchart of receiving channel-updating processing.

Next, the transmitting channel-updating processing and the receiving channel-updating processing will be described with reference to FIG. 15A and FIG. 15B. These processings are carried out by interruption when the channel switch is operated.

First, the transmitting channel-updating processing will be described with reference to FIG. 15A. When the transmitting channel number is changed from N1 to N2 at a step S1S1, the transmitting channel control data corresponding to the transmitting channel N2 is read from the control data storage block 12 at a step S152. Then, the transmitting channel control signal based on the transmitting channel control data is delivered via the control single output block 16 to the transmitter/receiver block 18 at a step S153. This sets the first local oscillation frequency of the transmitter/receiver block 18, to place the transmitter/receiver block 18 in a standby state for transmission of data. This terminates the present processing, and the program returns to the main routine.

Next, the receiving channel-updating processing will be described with reference to FIG. 15B. This processing is distinguished from the transmitting channel-updating processing in that according to this processing, in the receiver mode, the receiving channel control data designated by the channel switch is delivered. When the receiving channel number is changed from N1 to N2 at a step S161, the receiving channel control data corresponding to the receiving channel N2 is read at a step S162, and the receiving channel control signal is delivered to the transmitter/receiver block 18 at a step S163. This sets the first local oscillation frequency of the transmitter/receiver block 18, to place the transmitter/receiver block 18 in a standby state. This terminates the present processing, and the program returns to the main routine.

As described above, the transmitting channel-updating processing and the receiving channel-updating processing make it possible to set the transmitting frequency and the receiving frequency of the keyboard 2 as desired. Therefore, it is possible to change a combination of the present keyboard 2 and a tone generator of the other keyboard 2, as desired, permitting variation in the performance system comprised of keyboards.

As described heretofore, according to the present embodiment of the invention, the MIDI signal received from the keyboard (main part) 2 can be transmitted to the other keyboard as a radio signal to cause the other keyboard to operate as a tone generator. Further, inversely, based on the MIDI signal received from the other keyboard 2, the present keyboard 2 can be operated as a tone generator.

Further, the transmitter/receiver block 18 in the embodiment may be constructed such that it can transmit data by infrared rays.

Further, although in the above embodiment the assigner 21 is used as a memory for storing note-on data, this is not limitative, but a RAM or EEPROM (Electrically Erasable PROM) as a generally-used writable memory may be employed. Further, the contents for storage may be in the form of the note number data and the note-on data of MIDI data as they are, or in a converted form.

Further, although in the present embodiment, description is made as to transmission and reception of data between the keyboard 2 and the other keyboard 2, this is not limitative, but it is possible to carry out transmission and reception of data between all kinds of MIDI instrument devices, including performance devices, such as keyboards 2 and MIDI guitars, tone generators, and sequencers. Further, when the transmitter/receiver 3 as a circuit is connected to a performance information-recording device, such as a sequencer, the performance information-recording device can receive a radio signal transmitted from the other MIDI instrument device, and record a MIDI signal recovered by demodulating the radio signal.

Further, although in the above embodiment, the transmitter/receiver block 18 is constructed such that it is capable of transmitting and receiving a radio signal prepared by FM (Frequency Modulation), this is not limitative, but it goes without saying that there may be employed other modulation methods, such as on/off modulation of a high-frequency carrier, AM modulation, PM modulation, and pulse modulation. Further, although in the present embodiment, the transmitter/receiver block 18 is constructed such that it is possible to effect transmission and reception of data by a simplex method, this is not limitative, but it may be constructed such that it is possible to effect transmission and reception of data by a full duplex method.

What is claimed is:

1. A MIDI signal transmitter/receiver connected to a MIDI instrument device for mutually transmitting and receiving a MIDI signal between said MIDI instrument device and at least one other MIDI instrument device apart therefrom, comprising:

a transmitter block for modulating a high-frequency signal based on said MIDI signal delivered from said MIDI instrument device into a transmission radio signal and transmitting said transmission radio signal, when said MIDI signal transmitter/receiver is in a transmitter mode;

transmitter/receiver means for transmitting said transmission radio signal transmitted from said transmitter block to said other MIDI instrument device when said MIDI signal transmitter/receiver is in said transmitter mode, and receiving a reception radio signal based on said MIDI signal from said other MIDI instrument device when said MIDI signal transmitter/receiver is in a receiver mode;

a receiver block for demodulating said reception radio signal received by said transmitter/receiver means into said MIDI signal and delivering said MIDI signal recovered by demodulation by said receiver block to said MIDI instrument device, when said MIDI signal transmitter/receiver is in said receiver mode; and a transmission/reception changeover block for changing said MIDI signal transmitter/receiver to one of said transmitter mode and said receiver mode.

2. A MIDI signal transmitter/receiver according to claim 1, including:

memory means for storing MIDI data based on said MIDI signal delivered from said MIDI instrument device, and recovered MIDI data based on said MIDI signal recovered by demodulation by said receiver block; and a signal output block for delivering a MIDI signal based on said MIDI data stored in said memory means to said transmitter block or said recovered MIDI data stored in said memory means to said MIDI instrument device.

3. A MIDI signal transmitter/receiver according to claim 2, wherein said memory means is formed by a FIFO memory.

4. A MIDI signal transmitter/receiver according to claim 1, including a signal-detecting block for detecting said MIDI signal from said MIDI instrument device or said MIDI signal from said receiver block, wherein said transmission/reception changeover block changes said MIDI signal transmitter/receiver to said transmitter mode when said MIDI signal transmitter/receiver is in said receiver mode and said signal-detecting block detects said MIDI signal from said MIDI instrument device, and holds said MIDI signal transmitter/receiver in said receiver mode when said MIDI signal transmitter/receiver is in said receiver mode and said signal-detecting block detects said MIDI signal from said receiver block.

5. A MIDI signal transmitter/receiver according to claim 2, including a signal-detecting block for detecting said MIDI signal from said MIDI instrument device or said MIDI signal from said receiver block, wherein said transmission/reception changeover block changes said MIDI signal transmitter/receiver to said transmitter mode when said MIDI signal transmitter/receiver is in said receiver mode and said signal-detecting block detects said MIDI signal from said MIDI instrument device, and holds said MIDI signal transmitter/receiver in said receiver mode when said MIDI signal transmitter/receiver is in said receiver mode and said signal-detecting block detects said MIDI signal delivered from said receiver block.

6. A MIDI signal transmitter/receiver according to claim 4, including:

memory means into which note-on data of MIDI data based on said MIDI signal from said MIDI instrument device can be written;

writing means for writing said note-on data into said memory means, and for deleting said note-on data when note-off data of said MIDI data corresponding to said note-on data is input; and note data-detecting means for detecting presence or absence of said note-on data written in said memory means:

wherein said transmission/reception changeover block changes said MIDI signal transmitter/receiver to said receiver mode when said note data-detecting means detects absence of said note-on data written in said memory means.

7. A MIDI signal transmitter/receiver according to claim 5, including:

memory means into which note-on data of MIDI data based on said MIDI signal from said MIDI instrument device can be written;

writing means for writing said note-on data into said memory means, and for deleting said note-on data when note-off data of said MIDI data corresponding to said note-on data is input; and note data-detecting means for detecting presence or absence of said note-on data written in said memory means;

wherein said transmission/reception changeover block changes said MIDI signal transmitter/receiver to said receiver mode when said note data-detecting means detects absence of said note-on data written in said memory means.

8. A MIDI signal transmitter/receiver according to claim 6, including a counter for starting counting when said note data-detecting means determines that there remains in said memory means none of said note-on data written therein, wherein said transmission/reception changeover block inhibits said transmitter block from operating when said note data-detecting means continues to determine that there remains in said memory means none of said note-on data written therein, until the count of said counter reaches a predetermined value.

9. A MIDI signal transmitter/receiver according to claim 7, including a counter of starting counting when said note data-detecting means detects absence of said note-on data written in said memory means;

wherein said transmission/receiver block inhibits said transmitter block from operating when said note data-detecting means continues to detect said absence of said note-on data written in said memory means, until the count of said counter reaches a predetermined value.

10. A MIDI signal transmitter/receiver connected to a MIDI instrument device for mutually transmitting and receiving a MIDI signal between said MIDI instrument device and at least one other MIDI instrument device apart therefrom, comprising:

a transmitter block having a plurality of channels having different transmission frequencies from each other allotted thereto for modulating a high-frequency signal based on said MIDI signal delivered from said MIDI instrument device into a transmission radio signal and transmitting said transmission radio signal, when said MIDI signal transmitter/receiver is in a transmitter mode;

transmitter/receiver means for transmitting said transmission radio signal transmitted from said transmitter block to said other MIDI instrument device when said MIDI signal transmitter/receiver is in said transmitter mode, and receiving a reception radio signal based on said MIDI signal from said other MIDI instrument device when said MIDI signal transmitter/receiver is in a receiver mode;

a receiver block having a plurality of channels having respective reception frequencies different from each other allotted thereto for demodulating said reception radio signal received by said transmitter/receiver means into said MIDI signal and delivering said MIDI signal recovered by demodulation by said receiver block to said MIDI instrument device, when said MIDI signal transmitter/receiver is in said receiver mode;

a transmission/reception changeover block for changing said MIDI signal transmitter/receiver to one of said transmitter mode and said receiver mode; and a channel changeover block for selecting one of said plurality of channels for use.

* * * * *